US011589169B2

(12) United States Patent
Niekiel et al.

(10) Patent No.: US 11,589,169 B2
(45) Date of Patent: Feb. 21, 2023

(54) MEMS SOUND TRANSDUCER

(71) Applicant: Fraunhofer-Gesellschaft zur Foerderung der angewandten Forschung e.V., Munich (DE)

(72) Inventors: Malte Florian Niekiel, Itzehoe (DE); Fabian Stoppel, Itzehoe (DE); Thomas Lisec, Itzehoe (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/702,377

(22) Filed: Dec. 3, 2019

(65) Prior Publication Data

US 2020/0178000 A1 Jun. 4, 2020

(30) Foreign Application Priority Data

Dec. 4, 2018 (DE) ..... 102018220975.8
Feb. 11, 2019 (DE) ..... 102019201744.4

(51) Int. Cl.
*H04R 9/06* (2006.01)
*H04R 17/00* (2006.01)
*H04R 9/02* (2006.01)

(52) U.S. Cl.
CPC ..... *H04R 9/063* (2013.01); *H04R 9/025* (2013.01); *H04R 17/00* (2013.01); *H04R 2201/003* (2013.01); *H04R 2217/01* (2013.01)

(58) Field of Classification Search
CPC ..... H04R 9/063; H04R 17/00; H04R 9/025; H04R 2217/01; H04R 2201/003; H04R 9/00; H04R 19/00; H04R 7/06; H04R 7/26; H04R 31/003; H04R 19/02; H04R 19/04; H04R 2440/01; H04R 2499/11; H04R 7/10; H04R 19/005
See application file for complete search history.

(56) References Cited

U.S. PATENT DOCUMENTS 1,997,193 A * 4/1935 Kato ..... C04B 35/2666 252/62.56
2,576,679 A * 11/1951 Guillaud ..... C22C 28/00 29/608

(Continued)

FOREIGN PATENT DOCUMENTS

CN 1277792 A 12/2000
DE 102014217798 A1 3/2016

(Continued)

OTHER PUBLICATIONS

"Data Sheet Achelous, MEMS-based microspeaker for headphones, wearables and array applications", USound GmbH, 2018.

(Continued)

*Primary Examiner* — Angelica M McKinney
(74) *Attorney, Agent, or Firm* — Perkins Coie LLP; Michael A. Glenn

(57) ABSTRACT

A MEMS sound transducer includes a substrate, a membrane formed within the substrate, and a bending actuator applied onto the membrane. The membrane includes at least one integrated permanent magnet and is electrodynamically controllable. The bending actuator can be piezoelectrically controlled separately from the membrane.

17 Claims, 19 Drawing Sheets

(56) References Cited

U.S. PATENT DOCUMENTS

| | | | | |
|---|---|---|---|---|
| 3,701,865 | A * | 10/1972 | Carlson | H04R 7/16 257/419 |
| 6,389,148 | B1 | 5/2002 | Yoo et al. | |
| 9,221,217 | B2 | 12/2015 | Lisec et al. | |
| 9,237,961 | B2 | 1/2016 | Mitchell | |
| 2011/0051985 | A1* | 3/2011 | Hwang | H04R 17/00 381/396 |
| 2014/0023849 | A1 | 1/2014 | Lisec et al. | |
| 2016/0119721 | A1* | 4/2016 | Dos | H04R 1/1075 381/190 |
| 2016/0157021 | A1* | 6/2016 | Ishii | H04R 17/10 381/190 |
| 2017/0325030 | A1* | 11/2017 | Stoppel | H04R 17/00 |
| 2019/0037319 | A1* | 1/2019 | Ishii | H04R 1/24 |
| 2020/0087138 | A1* | 3/2020 | Schenk | H04R 7/06 |
| 2020/0100033 | A1* | 3/2020 | Stoppel | H04R 7/06 |
| 2020/0196067 | A1* | 6/2020 | Rusconi Clerici Beltrami | H04R 7/18 |

FOREIGN PATENT DOCUMENTS

| | | | |
|---|---|---|---|
| DE | 102017108594 | A1 | 10/2018 |
| DE | 102017208911 | A1 | 11/2018 |
| EP | 2670880 | B1 | 7/2018 |
| WO | 2018193038 | A1 | 10/2018 |

OTHER PUBLICATIONS

"Data Sheet Receiver 2323", Sonion, 2015.
"Product Data Sheet 2403 260 00132", Knowles Electronics LLC, 2013.
"What is Balanced Armature Receiver Technology", Sonion, Nov. 2016.
Aoyagi, I. et al., "A raster-output 2D MEMS scanner with an 8×4 mm mirror for an automotive time-of-flight image sensor", 17th International Conference on Solid-state Sensors, Actuators and Microsystems, Jun. 2013.
Arrasmith, C. L. et al., "MEMS-based handheld confocal microscope for in-vivo skin imaging", Opt. Express vol. 18, No. 4, Feb. 15, 2010, pp. 3805-3819.
Ayatollahi, F. L. et al., "Materials Design and Analysis of Low-Power MEMS Microspeaker Using Magnetic Actuation Technology", Adv. Mater. Res. 74, Jun. 3, 2009, pp. 243-246.
Bottoni, Ferruccio et al., "Challenging the audio Market with MEMS Micro Speaker Technology", presented at COMS2018, 2018.
Chen, Y C. et al., "A low-power milliwatt electromagnetic microspeaker using a PDMS membrane for hearing aids application", IEEE Int. Conf. Micro Electro Meeh. Syst., Jan. 2011, pp. 1213-1216.
Cheng, Ming-Cheng et al., "A silicon microspeaker for hearing instruments", J. Micromech. Microeng. 14 (2004), pp. 859-866.
Jadhav, P R. et al., "A sub-mW Electromagnetic Micro-speaker with Bass Enhancement using a Parylene/Graphene/Parylene Composite Membrane", IEEE Micro Electro Mechanical Systems (MEMS), 2018, pp. 620-623.
James, Dick, "STMicroelectronics Micromirrors, Microvision and Sony Bring Pico-Projection to the Pocket", Dec. 3, 2015.
Je, Sang-Soo et al., "A Compact and Low-Cost MEMS Loudspeaker for Digital Hearing Aids", IEEE Trans. Biomed. Circ. Sys. Vol. 3, No. 5, Oct. 5, 2009, pp. 348-358.
Majlis, Burhanuddin Y. et al., "Compact electrodynamics MEMS-speaker", China Semiconductor Technology International Conference (CSTIC), 2017.
Reimer, Tim et al., "Temperature-stable NdFeB micromagnets with high-energy density compatible with CMOS backend of line technology", MRS Advances 1, (2016), pp. 209-213.
Shahosseini, Iman et al., "Optimization and Microfabrication of High Performance Silicon-Based MEMS Microspeaker", IEEE Sens. J. vol. 13, No. 1 (2013), pp. 273-284.
Shearwood, C et al., "Applications of Polyimide Membranes to MEMS Technology", Microelectron. Eng. 30 (1996), pp. 547-550.
Stoppel, Fabian et al., "New integrated full-range MEMS speaker for in-ear applications", IEEE Micro Electro Mechanical Systems (MEMS), 2018.
Sturtzer, Eric et al., "High fidelity microelectromechanical system electrodynamic microspeaker characterization", J. Appl. Phys. 113 (2013).
Zhang, Qian et al., "Fully-microfabricated electromagnetically-actuated membrane for microspeaker", Transducers '15, Int. Conf. Solid.State Sens., Actuators Microsyst., Jun. 21-25, 2015, pp. 2125-2128.

* cited by examiner

MEMS SOUND TRANSDUCER

CROSS-REFERENCE TO RELATED APPLICATION

This application claims priority from German Patent Application No. DE 102018220975.8, which was filed on Dec. 4, 2018, and German Patent Application No. DE 102019201744.4, filed Feb. 11, 2019, which are incorporated by reference herein in their entirety.

Embodiments of the present invention relate to a MEMS sound transducer and to applying the MEMS sound transducer, e.g., in headphones (e.g. in-ear headphones) and free-field loudspeakers in mobile devices. Further embodiments relate to a corresponding manufacturing method.

BACKGROUND OF THE INVENTION

Sound transducers serve to generate airborne sound within the audible range for interacting with the human sense of hearing. Micro loudspeakers are characterized by as small dimensions as possible and are applied, in particular, in portable devices of the entertainment and telecommunication industries, e.g. smartphones, tablets and wearables. Micro loudspeakers are also used in medical engineering, e.g. in hearing aids for supporting individuals who are hard of hearing.

The technical challenge with micro sound transducers consists in achieving high sound pressure levels, SPLs. For a piston-type resonator (piston-type transducer), the achieved sound pressure level in the free field at a distance r at the frequency f is $$SPL_r(f) = 20\log_{10}\left(\frac{\sqrt{2}\,\pi\rho A\bar{s}f^2}{p_{ref}\,r}\right),$$

wherein A is the active surface, $\bar{s}$ is the deflection of the active surface, ρ is the density of the air, and $P_{ref}$ is the reference pressure (20 μPa).

Within a confined volume $V_0$, the so-called pressure-chamber effect occurs, the achieved sound pressure level can be calculated to amount to $$SPL_{v_0} = 20\log_{10}\left(1.4\frac{p_0 A\bar{s}}{p_{ref}\,v_0}\right),$$

wherein $p_0$ wherein is the pressure within the confined volume.

Thus, it is both in the free field as well as within the confined volume (e.g. with in-ear applications) that the achieved sound pressure level is directly proportional to the displaced volume $A\cdot\bar{s}$ (prior to conversion to the logarithmic scale). The technical challenge with micro loudspeakers thus consists in displacing a sufficient amount of volume so as to generate high sound pressure. When assuming a constant maximum deflection, the displaced volume in turn will be directly proportional to the deflected active surface, which is limited by the external dimensions of a micro loudspeaker. With micro loudspeakers for free-field applications, the frequency dependence of the achieved sound pressure level has significant effects. The sound pressure level will rapidly decrease to low frequencies (12 dB per frequency halving). In conventional loudspeakers, this effect is compensated for via the surface, which is not an option with micro loudspeakers. Therefore, in the free field, micro loudspeakers typically exhibit a severe drop in the SPL at low frequencies.

Further requirements placed upon micro loudspeakers stem directly from the applications. For example, as low a distortion as possible (total harmonic distortion, THD) is decisive for the listening experience. In particular, in applications of entertainment electronics, e.g. music playback via headphones, high fidelity is indispensable. For applications in mobile devices, high energy efficiency is indispensable so as to ensure as long battery run times as possible. Alternatively, the battery size may be reduced, so that further miniaturization of the overall system becomes possible (e.g. for hearables).

According to conventional technology, there have been several concepts which will be explained below with reference to FIGS. 1 to 8.

As conventional loudspeakers have been developed further, micro loudspeakers have emerged from miniaturizing the established electrodynamic drive. In immersion-coil arrangements, which are most widely spread, a coil is mounted on the rear side of the membrane which moves as a current signal is applied within the magnetic field of a fixed permanent magnet, and thus deflects the membrane.

The micro loudspeaker depicted in FIG. 1*a* is based on the design having an electrodynamic drive. The micro loudspeaker includes a membrane 1*m*, which is movable in relation to a frame 1*r*. The drive includes an immersion coil 1*s*, which is coupled to the membrane 1*m* and dips into a magnetic field of the permanent magnet 1*p*. The permanent magnet 1*p* is connected to the frame 1*r*. In FIG. 1*b*, the transmission characteristics (transient response) in the free field are shown on the basis of an exemplary size of 10 mm×15 mm×3.5 mm.

One development of the hearing-aid applications are the so-called balanced armature transducers (BA transducers). A rod 1*s* having a coil wound around it is located within the gap of an annular permanent magnet 1*p* and is connected to a membrane 1*m* (see FIG. 2*a*). A current signal applied to the coil magnetizes the rod, which will then have a torque acting on it on account of the magnetic field of the permanent magnet. The rotation is transferred to the membrane via a rigid connection. In its basic condition, the rod is in an instable equilibrium of the magnetic forces of attraction. Because of this instable state, relatively large deflections may be achieved with low expenditure (driving forces, energy). BA transducers are therefore characterized in that higher sound pressure levels may be achieved, and are advantageously utilized for in-ear applications due to their design size. FIG. 2*b*) shows, by way of example, the achieved sound pressure level of a BA transducer of a size of 8.6 mm×4.3 mm×3.0 mm, measured within a confined volume.

FIG. 3*a* shows a MEMS loudspeaker on the basis of piezoelectric bending actuators 1*b* which deflect a membrane 1*m* mounted in a hybrid manner. [0004], [006]. A loudspeaker module having dimensions of 5.4 mm×3.4 mm×1.6 mm achieves a sound pressure level $SPL_{1.4\,cm^3}$ of at least 106 dB (approx. 116 dB at 1 kHz) [5] across a frequency range of 20 Hz-20 kHz within a confined volume. Market introduction of a first product for in-ear applications is expected as of 2019. As FIG. 3*b*) suggests, a significant sound pressure level will be achieved even in the event of irradiation into the free field.

One further development of this approach are MEMS loudspeakers based on piezoelectric bending actuators which make do without any additional membrane (see FIG. 4*a*). To this end, the actors themselves form the acoustically radiating membrane. A loudspeaker chip having an active surface of 4 mm×4 mm achieves, within a confined room, a sound pressure level $SPL_{1.26\ cm^3}$ of at least 105 dB (approx. 110 dB at 1 kHz, as indicated in FIG. 4.*b*) [7].

What is particular about these sound transducers is that the membrane 1*m* is configured to consist of several parts, all of the individual parts (here quadrants) being separated from one another by a corresponding gap 1*ms*. In this variant, the individual piezoelectric elements for the membrane parts are arranged on the membrane itself (cf. reference numeral 1*b*). The gap 1*ms* is dimensioned to result in as good a sealing effect as possible (encapsulation of the area in front of the membrane from the region behind the membrane). To this end, the gap is selected to be as small as possible, in particular in relation to the frequency to be transmitted.

Various concepts of electrodynamically actuated MEMS loudspeakers have also been known [8]. FIG. 5*a*) shows the schematic design of the component [9]. A stiffened Si membrane suspended by Si springs forms a piston-type resonator. The coil is mounted directly onto the Si membrane as a planar coil and moves the membrane within the magnetic field of a permanent magnet mounted in a hybrid manner. The SPL achieved in the free field is depicted in FIG. 5*b*) [10]. Within the low frequency range, the performance of the piezoelectrically actuated loudspeaker is clearly exceeded, as shown in FIG. 3. The chip has a size of approx. 11 mm in diameter×4 mm in height.

A related approach adapted by several groups [11, 12, 13, 14, 15, 16] consists in mounting the planar coil onto a soft polymer membrane instead of the stiffened Si membrane, see FIG. 6*a*). In FIG. 6*b*), the achieved sound pressure of a prototype of approx. 4 mm in diameter and 2 mm in height is shown. Since this measurement was performed within a confined volume, the achieved sound pressure levels cannot be directly compared to those of FIGS. 3 and 5.

As opposed to piezolectrically actuated MEMS loudspeakers, electrodynamically driven MEMS loudspeakers are still a long way from commercial utilization, however. Due to the hybrid-type mounting of the magnets that may be used, there are no advantages in cost as compared to conventional technology. The small cross-section of the turns of integrated planar coils as well as the poor heat dissipation via the thin membrane limit the coil current, so that the sound pressure level of conventional micro loudspeakers is not attained to. The problem of current limitation may be reduced by placing the planar coil onto the substrate and by placing the magnet onto the movable membrane instead. Due to the high thermal conductivity of silicon, current densities that are higher by orders of magnitude will then be possible within the coil. FIG. 7 shows two published illustrations [17, 18]. In the component of FIG. 7*a*, the micro magnets were integrated at the substrate level. To this end, NdFeB powder was introduced into etched micro molds and subsequently solidified by means of wax [18]. Due to the insufficient durability of the wax-bound structures, however, this development has not gone beyond a prototype.

The lack of high-performing micro magnets having high durability which may be integrated at the substrate level is one of the main reasons why electrodynamically actuated actuators so far have not been able to gain acceptance in MEMS components. One exception are electrodynamic MEMS scanners, which have already been used in commercial products. One known example is the MEMS scanner by MicroVision, see FIG. 8 [19], which is employed within a Pico projector by Sony [20]. Unlike MEMS loudspeakers, the forces that may be used for driving are comparatively small in MEMS scanners. In addition, there are decisive advantages as compared to conventional technology, e.g. the possibility of quasi-static operation at a high frequency. As is illustrated in FIG. 8 in the example of a design developed by Toyota, this can justify even the largest expenditure in terms of the surrounding components [21].

Therefore, the disadvantage of either the limited frequency range, of limited generation of sound pressure across the desired frequency range, the ability to be miniaturized and/or the limited ability of being produced in a simple and low-cost manner are reflected in each conventional-technology solution. Thus, there is a need for an improved approach.

SUMMARY

According to an embodiment, a sound transducer may have: a substrate; a membrane which is formed within the substrate, is connected to at least one integrated permanent magnet and is electrodynamically controllable; and a bending actuator which is applied onto the membrane and can be piezoelectrically controlled separately from the membrane.

According to another embodiment, a micro loudspeaker, headphone or in-ear headphone may have at least one inventive MEMS sound transducer.

According to another embodiment, a method of producing an inventive sound transducer may have the step of: agglomerating powder to produce at least one permanent magnet or to produce at least one permanent magnet on the membrane.

Embodiments provide a MEMS sound transducer comprising a substrate. A membrane which is connected to at least one integrated permanent magnet and may be controlled electrodynamically, e.g., while using a coil, by means of a first control signal is formed within or on the substrate, e.g. within a cavity. Due to the electromagnetic drive, the membrane may act as a piston-type drive, for example. The membrane has a bending actuator mounted thereon which may be controlled separately from the membrane (e.g. via a second signal).

Embodiments of the present invention are based on the finding that by integrating a piezoelectric MEMS sound transducer into a MEMS sound transducer having an electrodynamic drive, a two-way micro loudspeaker may be provided in MEMS technology. Due to the electrodynamic drive, the two-way micro loudspeaker is characterized by higher achievable sound pressure levels at low frequencies as compared to existing solutions. For example, when sound is irradiated into the free field, the drop in the achieved sound pressure toward low frequencies may be compensated for. On the other hand, loudspeakers for confined volumes (in-ear headphone application) may be implemented which have considerably increased sound pressure levels particularly within the bass range.

In particular for noise cancelation applications, very high sound pressures of frequencies below 100 Hz may be used. Hearing aids also place particularly high requirements on the sound pressures achieved, which so far can be achieved only across portions of the acoustic frequency range. Implementation as two-way loudspeakers also allows optimization of the individual components for the respective frequency range. For example, an electrodynamic drive for low frequencies may be combined with a piezoelectric drive for high frequencies so as to achieve the best energy efficiency and lowest distortion. Manufacturing in MEMS technology enables high-volume production with utmost precision.

In accordance with a further embodiment, the membrane, in particular that region of the membrane that is controlled via the bending actuator, may be configured as several parts. For example, the membrane may be divided into two halves by one gap or may be divided into four or more parts by several gaps. In accordance with embodiments, the gap is selected to be very thin, so that no additional sealants are required. In a non-deflected state of the bending actuator, the gap may be, e.g., smaller than 5 μm, smaller than 25 μm, smaller than 50 μm, or smaller than 100 μm. As an alternative to the bending actuator with a membrane divided by a gap, the bending actuator may also be equipped with an additional membrane driven via the bending actuator. The variant which comprises the gap is easy to manufacture and enables high deflectability without any distortions.

In accordance with embodiments, the electrodynamically driven membrane is connected to a frame which is electrodynamically controlled along with the membrane. In accordance with further embodiments, the one or more permanent magnets may be integrated into said frame. In accordance with further embodiments, said permanent magnets interact with a coil on the substrate or in the region of the substrate so as to electrodynamically drive the membrane.

The membrane or the frame of the membrane is spring-mounted in relation to the substrate. In accordance with embodiments, spring mounting may be implemented, for example, by a decoupling slit, a structure, or baffle structure, or an elastic connection or other means. When considering the advantageous variant of using a decoupling slot, it shall be noted at this point that said decoupling slot is configured to be as thin as possible, i.e., for example, smaller than 5 μm, smaller than 25 μm, smaller than 50 μm, or smaller than 100 μm. When considering the embodiment in the form of the baffle structure, it shall be noted at this point that said embodiment may optionally protrude from the substrate plane, the baffle structure having a height of at least 0.5 or 0.75 or 1.0 of the maximum deflection of the electrodynamically driven membrane.

In accordance with embodiments, the piezoelectric bending actuators and the electrodynamic drive are responsible for different frequency ranges. The MEMS sound transducer is configured to reproduce a first frequency range by means of the electrodynamically drivable membrane and to reproduce a second frequency range by means of the bending actuator. The second frequency range has a center frequency higher than that of the first frequency range, or in total has frequencies higher than those of the first frequency range. This may be ensured, in accordance with further embodiments, e.g. by a filter (signal processing) in that, e.g., the high frequencies may be filtered out of the electrodynamic drive. Also, subdividing two frequency ranges by means of signal processing is feasible.

One embodiment relates to headphones such as, in particular, in-ear headphones, which include a MEMS sound transducer as was described above. As was already mentioned above, such applications may be characterized in that they exhibit a good frequency range to be transmitted which has a high sound pressure level.

A further embodiment relates to a method of producing a MEMS sound transducer as was explained above. The method includes a central step of agglomerating powder to produce magnets or to produce permanent magnets (which are coupled to the membrane) or to produce at least one permanent magnet on the membrane.

BRIEF DESCRIPTION OF THE DRAWINGS

Embodiments of the present invention will be detailed subsequently referring to the appended drawings, in which:

FIGS. 10*a*, 10*b* show schematic representations of a MEMS sound transducer in accordance with extended embodiments, wherein FIG. 10*a* illustrates a basic state and FIG. 10*b* illustrates a deflected state of the electrodynamically driven actuator system (low-frequency range);

DETAILED DESCRIPTION OF THE INVENTION

Figure 1B:
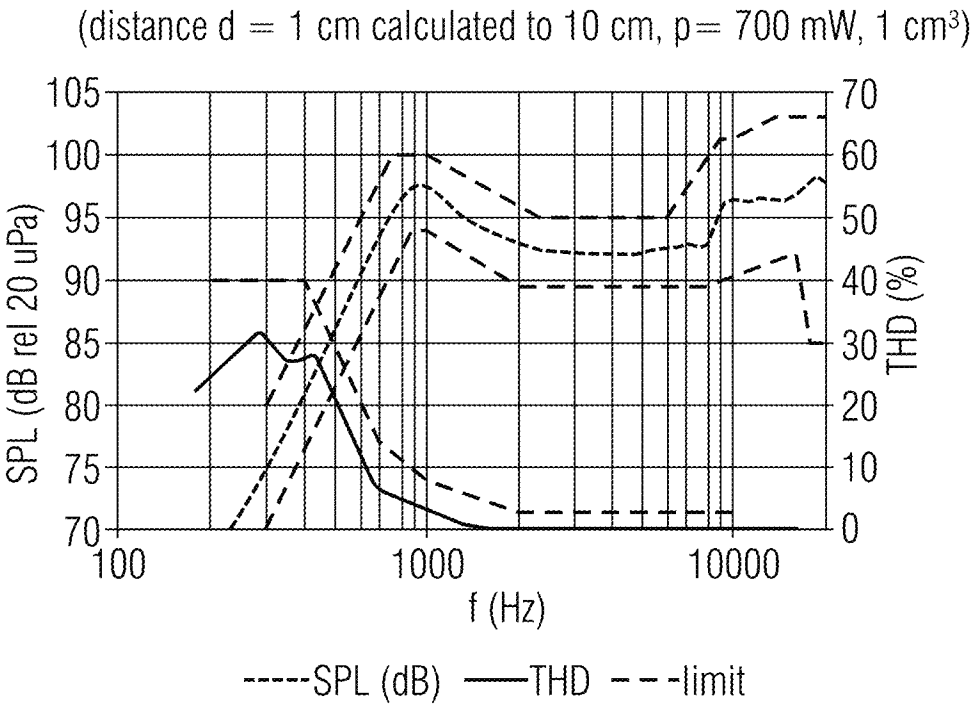
FIG. 1*a*-2*b* and FIGS. 5*a*-8*b* show schematic representations of MEMS sound transducers in accordance with conventional-technology implementations, partly along with the corresponding performance data.

Before embodiments of the present invention will be explained below with reference to the accompanying drawings, it shall be noted that elements and structures which are identical in action have been provided with identical reference numerals, so that their descriptions shall be mutually applicable, or interchangeable.

Figure 9:
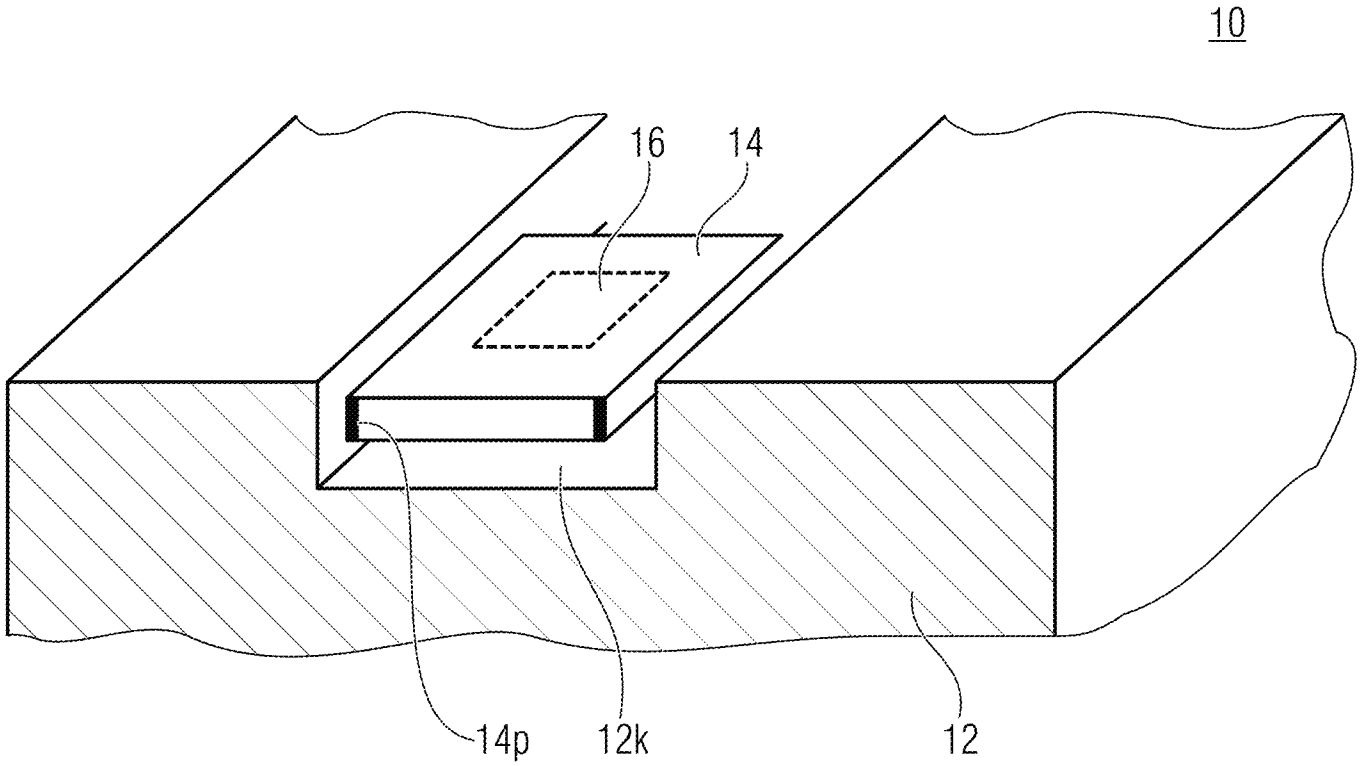
FIG. 9 shows a schematic representation of a MEMS sound transducer in accordance with a basic embodiment.

FIG. 9 shows a MEMS sound transducer 10 formed, e.g., within a substrate 12 (Si substrate, conventional semiconductor substrate for MEMS components, or other substrate). The MEMS sound transducer 10 includes a membrane 14 formed within the substrate and comprising at least one integrated permanent magnet 14*p*, the latter being formed, in the present variant, within the frame region of the membrane 14, for example.

With the aid of said permanent magnet 14*p*, the membrane 14 may be electrodynamically actuated from outside, e.g. by means of a coil (not depicted).

The membrane 14 has a bending actuator 16 applied thereon which may be actuated separately from the membrane, specifically in a piezoelectric manner.

The membrane 14 is actuated in an electrodynamic manner, for example, in that the substrate 12, in particular the cavity 12*k*, has a coil provided therein which has a first control signal applied to it. A piston-type resonator is traditionally capable of implementing larger strokes and, therefore, also to implement an external sound pressure, in particular at low frequencies. This means that the membrane 14 has a control signal applied to it which tends to reproduce the lower frequencies (e.g. below 5,000 Hz or below 3,000

Hz or also below 1,000 Hz). Optionally, it would also be feasible for this signal to already have been low-pass filtered. Piezoelectric sound transducers (cf. piezoelectric bending actuator 16) typically have a lower limit in terms of their frequency response, so that they are good at reproducing especially relatively high frequencies. The piezoelectric actuator 16 here has a second audio signal applied to it which includes mainly high-frequency portions (above 5,000 Hz, above 3,000 Hz, above 1,000 Hz). The transition frequency may therefore range between 1,000 and 5,000 Hz, depending on the implementation. In accordance with further embodiments, the transition frequency might also be within a different range, e.g. between 100 and 10,000 Hz.

With regard to controlling with different frequency bands, it shall be noted that it is not mandatory here for the frequency bands to be subdivided in advance, so that each of the two sound transducers of the different types 14 and 16 may be controlled with the same signal or the pre-processing signal. Should the signal have been pre-processed (e.g. have been subdivided into first and second signals), this will typically have been derived from a shared audio signal.

Extended variants of the two-way MEMS sound transducer 10 will be explained below with reference to FIGS. 10*a* and 10*b*.

Figure 10B:
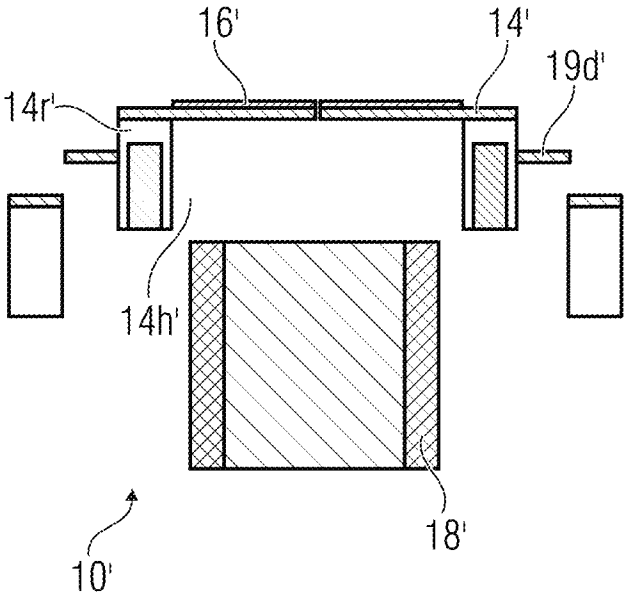
Figure 10A:
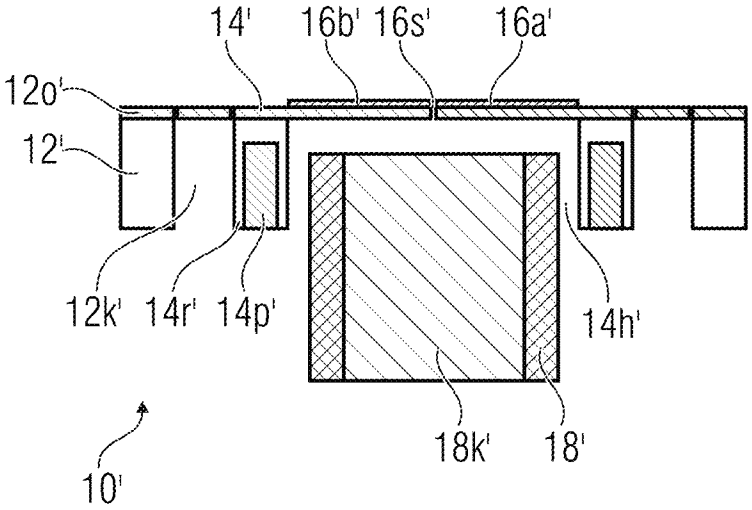

FIG. 10*a* represents the basic state of the electrodynamically driven transducer, whereas FIG. 10*b* represents the deflected state of the electrodynamically driven transducer.

FIGS. 10*a* and 10*b* show a MEMS sound transducer 10' comprising a membrane, here an Si membrane 14'. Said membrane 14' rests upon a frame 14*r*', which surrounds, or extends along, the outer contour of the membrane 14'. In this embodiment, the frame 14*r*' comprises one or more integrated permanent magnets 14*p*'. In addition, the frame 14*r*' extends, along with the magnet 14*p*', perpendicularly to the lateral membrane and into the interior of the MEMS device 10'. By means of the frame 14*r*' and the membrane 14', a cavity 14*h*' is formed on the rear side (that side which is located opposite the irradiation surface of the membrane 14').

As can be seen in FIG. 10*a*, the membrane 14' lines up, in the basic state, precisely with the surface 12*o*' of the substrate 12'. The substrate 12' in turn forms a cavity 12*k*' which has the membrane 14' with the frame 14*r*' arranged therein. In addition, the cavity 12*k*' has a coil 18' located therein which is configured to interact with the permanent magnet 14*p*' and to electrodynamically drive the membrane 14' via the frame 14*r*'. Alternatively, the coil may also be arranged on the side or below the membrane. For example, the coil may also be located on a separate carrier (substrate). Because of the electrodynamic drive, piston-type deflection results, as can be seen in FIG. 10*b*. In this embodiment, the coil 18' is positioned, in relation to the membrane 14' and/or in relation to the frame 14*r*', such that said membrane is arranged, in the basic state, within the cavity 14*h*' but does not touch the frame 14*r*' or the membrane. In accordance with embodiments, the coil 18' is an on-chip integrated planar or multilayer coil, a (conventionally) wound coil, a multilayered coil integrated on a circuit board, or a coil based on ceramic materials. In accordance with optional embodiments, the coil may comprise a core material 18*k*'. Thereby the effect of the coil 18' may be increased.

As can be seen, in particular, from the illustration of FIG. 10*b*, sealants 19*d*' are provided between the membrane 14', which may be movable in the manner of a piston and comprises the frame 14*r*', and the substrate 12', said sealants 19*d*' sealing the gap between the oscillating element 14' plus 14*r*' and the frame 12'. This may be an elastic element or a kind of baffle or the like.

In terms of geometries it shall be noted that FIGS. 10*a* and 10*b* here depict sectional representations, so that it shall be noted, with regard to lateral expansion of elements 14', 14*r*', 18' etc., that said elements may either have rectangular, square, round or comparable shapes. When one assumes a round shape, for example, it is to be noted that the coil 18', the cavity 14*h*', the frame 14*r*', the membrane 14', and the cavity 12' extend concentrically, i.e. have one common axis of symmetry.

The membrane 14' has a piezoelectric layer 16' applied to it or integrated thereon. In this embodiment, the piezoelectric bending actuator 16' is configured in two parts, i.e. comprises a gap 16*s*'. Said gap separates the first part of the piezoelectric structure 16*a*' from the second part of the piezoelectric structure. In this embodiment, the gap 16*s*' continues also through the membrane 14'. It shall be noted at this point that said provision of gap 16*s*', or said separation, represents an optional feature since the piezoelectric bending actuator may also act, e.g., as a single piezoelectric layer that has been applied, as will be explained with reference to FIG. 9.

Just like the structures as well as the separate modes of operation of the individual elements were explained above, the two-way MEMS sound transducer, which here is provided by the MEMS component 10', will be explained in its total functionality. The woofer is electrodynamically driven via the electrodynamic drive 18' in combination with 14*p*', while the active surface of the woofer 14' additionally contains the tweeter 16', or 16*a*' plus 16*b*'. Therefore, the functionality of the tweeter here is implemented by piezoelectric bending actuators as are described, for example, in [7].

The entire tweeter 16' is spring-mounted together with the frame 14*r*', so that the frame 14*r*' may be vertically deflected along with the tweeter 16' and the membrane 14'. The driving force for vertical deflection results from a magnetic field generated by the coil 18'. The coil 18' here is arranged centrally below the frame 14*r*' of the tweeter 16'. By means of a suitable core material, the magnetic field, and, therefore, the force acting on the integrated permanent magnet 14*p*' within the frame 14*r*' of the tweeter 16' is amplified. The vertical deflection of the tweeter 16' including the frame 14*r*', which is caused by the variable signal of the coil, enables the functionality of the woofer.

Before manufacturing as well as the performance of the MEMS structure 10' depicted here will be addressed, the optional aspects of the gap 16*s*' and the sealing 19*d*' will be explained in somewhat more detail with reference to FIGS. 10*c*, 10*d*, and 10*e*.

Figure 10C:
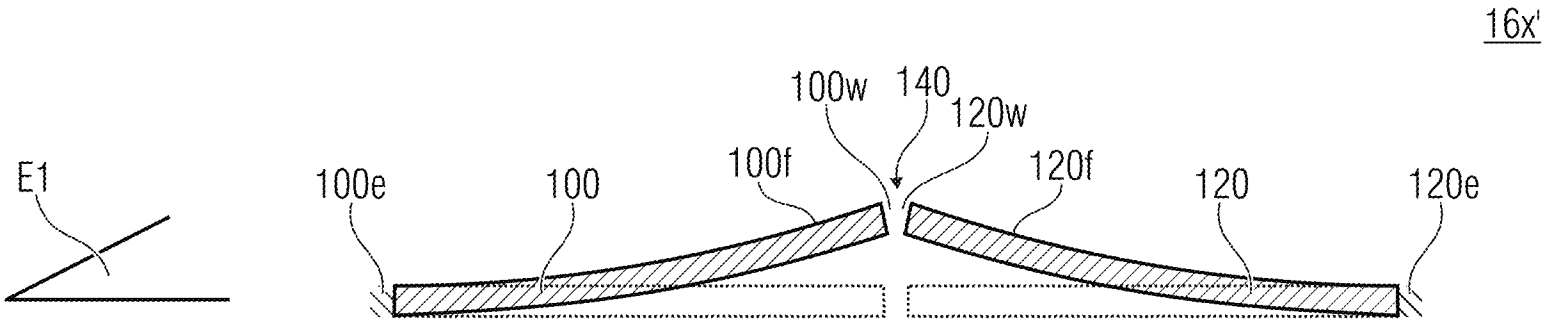
FIGS. 10*c*-10*e* show schematic representations for illustrating variations of the MEMS sound transducer in accordance with the embodiment of FIG. 10*a/b;*

FIG. 10*c* shows a possibility of how sealing may be effected by means of a gap (comparable to gap 16*s*'). The variant depicted here in FIG. 10*c* is predestined for being employed within the tweeter of FIGS. 10*a* and 10*b*. FIGS. 10*d* and 10*e* show variants for providing a sealing at the edge of a moved structure. Said variants are also predestined for using the structure instead of sealants 19*d*'.

FIG. 10*c* shows a sound transducer 16*x* comprising a first bending actuator 100 and a second bending actuator 120. Both are arranged, or clamped, within a plane E1, as can be seen by means of clamping 100*e* and 120*e*. It shall be noted at this point that the bending actuators 100 and 120 depicted here may be biased, for example, so that the picture either represents an idle state or shows a deflected snapshot (for this case, the idle state is depicted by the dashed line). As can be seen, the two actuators 100 and 120 are arranged horizontally next to each other, so that the actuators 100 and 120 or at least the clamps 100*e* and 120*e* lie within a common plane E1. This statement advantageously refers to the idle state; in the case of biasing, the plane E1 relates above all to the shared clamping regions 100*e* and 120*e*.

The two actuators 100 and 120 are arranged to be located opposite each other, so that they have a gap 140 of, e.g., 5 μm, 25 μm, or 50 μm (generally within the range from 1 μm to 90 μm, advantageously smaller than 50 μm or smaller than 20 μm) between them. Said gap 140, which separates the cantilevered bending actuators 100 and 120, may be referred to as a decoupling gap. The decoupling gap 140 varies only to a minimum extent, i.e. less than by 75% or less than by 50% of the gap width, across the entire deflection range of the actuators 100 and 120, so that additional sealing may be dispensed with, as will be explained below.

Actuators 100 and 120 are driven in a advantageously piezoelectric manner. Each of said actuators 100 and 120 may comprise a layered design and may have one or more passive functional layers in addition to the piezoelectric active layers. Alternatively, electrostatic, thermal or magnetic drive principles are also possible. If a voltage is applied to the actuators 100, 120, said actuators—or, in the piezoelectric case, the piezoelectric material of the actuators 100 and 120—will deform and cause the actuators 100 and 120 to bend such that they will protrude from the plane. Said bending results in air being displaced. With a cyclic control signal, the respective actuator 100 and 120 is then excited to vibrate so as to emit a sound signal. The actuators 100 and 120, or the corresponding control signal, are/is configured such that respectively adjacent actuator edges, or the free ends of the actuators 100 and 120, will undergo almost identical deflections out of the plane E1. The free ends are indicated by reference numerals 100*f* and 120*f*. Since the actuators 100 and 120, or the free ends 100*f* and 120*f*, move in parallel with each other, they are in phase. Consequently, deflection of actuators 100 and 120 is referred to as being identical in phase.

Subsequently, a steady deflection profile will form in the overall structure of all actuators 100 and 120 in the driven state, which deflection profile is interrupted only by the narrow decoupling slots 140. Since the gap widths of the decoupling slots lie within the micrometer range, high viscosity losses will occur on the gap side walls 100*w* and 120*w*, so that the airflow passing through here is heavily reduced. Thus, the dynamic pressure compensation between the front sides and the rear sides of actuators 100 and 120 cannot occur fast enough, so that an acoustic short-circuit is avoided irrespectively of the actuator frequency. This means that an actuator structure having narrow slots will behave, in terms of flow, like a closed membrane within the acoustic frequency range considered.

Figure 1A:
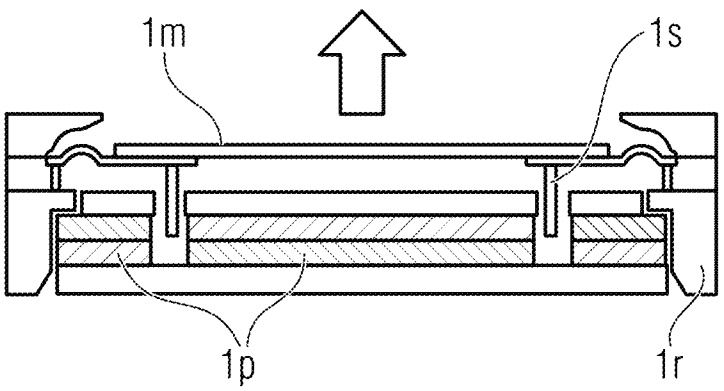
Figure 2B:
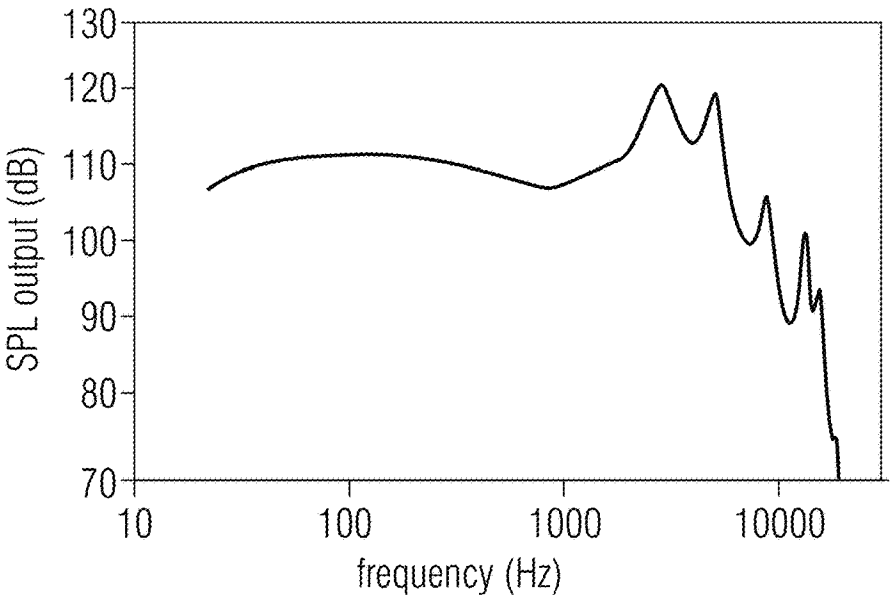
Figure 2A:
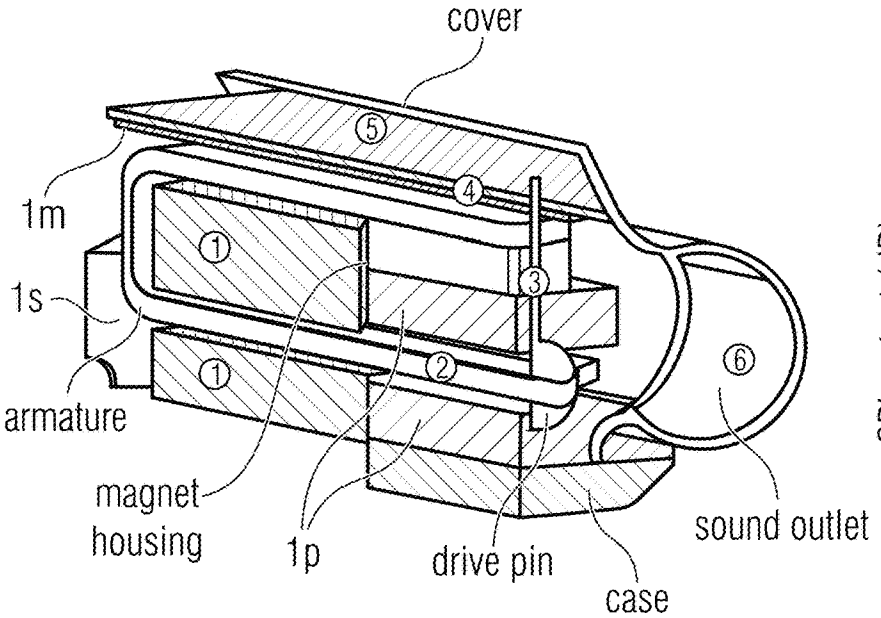
Figure 10D:
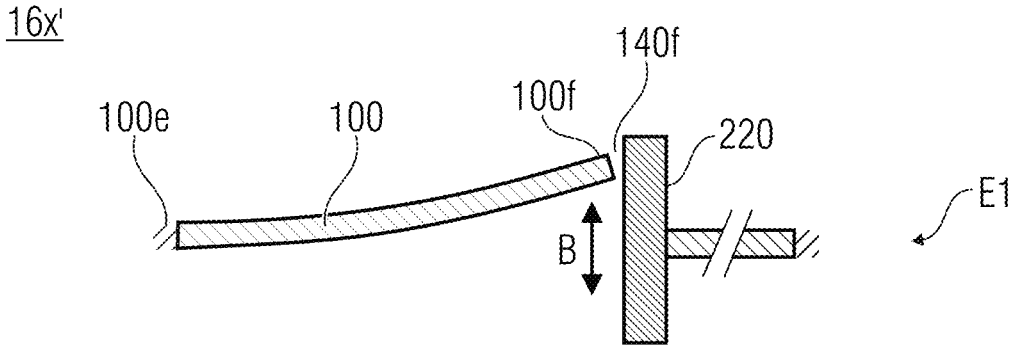

FIG. 10*d* shows a further variant of how an actuator of a micromechanical sound transducer may achieve high sound pressure performance without sealing. The embodiment of FIG. 10*d* shows the sound transducer 16*x*' including the actuator 100, which is fixedly clamped at point 100*e*. The free end 100*f* may be excited to oscillate across a region B. A vertically arranged baffle element 220 is provided opposite the free end 100*f*. Said baffle element is advantageously at least equal in size or larger than the region of movement B of the free end 100*f*. The baffle elements 220 advantageously extend on the front and/or rear side of the actuator, i.e., when viewed from the plane E1, into a plane that is located further down and a plane that is located further up. A gap 140*f* that is comparable to gap 140 of FIG. 1*a* is provided between the baffle element 220 and the free end 100*f*.

The baffle element 220 allows keeping the width of the provided decoupling gaps 140' more or less constant even in the deflected state (cf. B). Thus, with this configuration having the adjacent edges, no significant openings will arise as a result of the deflection, as is depicted in FIG. 10*e*, for example.

Figure 10E:
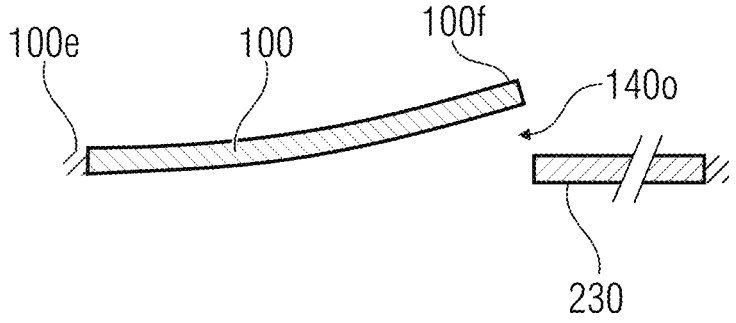
Figure 10H:
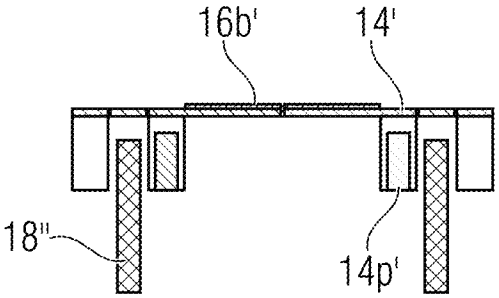
FIGS. 10*f*-10*m* show schematic representations for illustrating variations of the MEMS sound transducer in accordance with further embodiments.

FIG. 10*e* shows an actuator 100 which is also clamped in at point 100*e*. A structure 230 which may abut at any location desired and which has no vertical extension and no movement is provided opposite. As a result of a deflection of the actuator 100, an opening will arise in the region of the free end 100*f* of the actuator. This opening is provided with reference numeral "o". Depending on the deflection, these opening cross sections 140*o* may be clearly larger than the decoupling slots (cf. FIGS. 10*c* and 10*d*) and/or than a decoupling slot in the idle state. Because of the opening, an air flow may occur between the front and rear sides, which results in an acoustic short-circuit.

In accordance with embodiments, the side face of the baffle element 220, or the baffle element 220 itself, may be within the deflection range B, in a manner that is adjusted to the movement of the actuator 100. Specifically, a concave shape would be feasible.

With reference to FIGS. 10*f* to 10*m*, variations of the arrangement of the coil 18' and of the coil core 18*k*' will now be explained; the remaining design essentially corresponds to that of the embodiment of FIG. 10*a*.

Figure 10G:
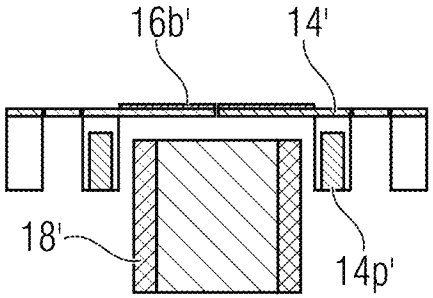
Figure 10F:
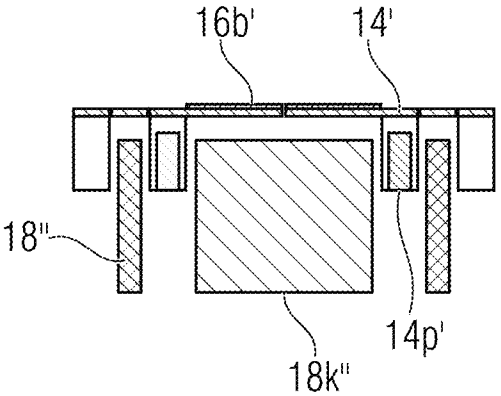

In the embodiment of FIG. 10*f*, the coil 18" is arranged between the substrate and the membrane 14', i.e. laterally (concentrically outside) in relation to the magnet 14*p*' (below the optional sealing). As compared to FIG. 10*a*, the core 18*k*" remains, unchanged, in the central position.

By means of this variant, the core 18*k*" in the central position may be enlarged, and the space in which the arrangement 18" and 18*k*" is/are provided may be exploited to a maximum. Due to the fact that (at least in the idle position) the magnet 14*p*' is provided between the coil 18" and the core 18*k*", the maximum magnetic force is transferred when the coil 18" is controlled. If one assumes a round membrane, the arrangement between the substrate and the magnet 14*p*' is to be understood to mean that here, elements 18", 14*p*' and 18*k*" are concentrically nested within one another. If one assumes a different shape, such as a square shape, for example, said nesting would also be possible, of course.

The embodiment of FIG. 10*g* corresponds to that of FIG. 10*a*, but no core is provided. The embodiment of FIG. 10*h* corresponds to that of FIG. 10*f*, but no core is provided.

Both embodiments essentially fulfil the same functionality as the corresponding basic embodiments of FIGS. 10*a* and 10*f*; since the core is dispensed with, the overall weight of the sound transducer component is significantly reduced; however, it is also possible that lower resulting forces will act on the membrane.

Figure 10J:
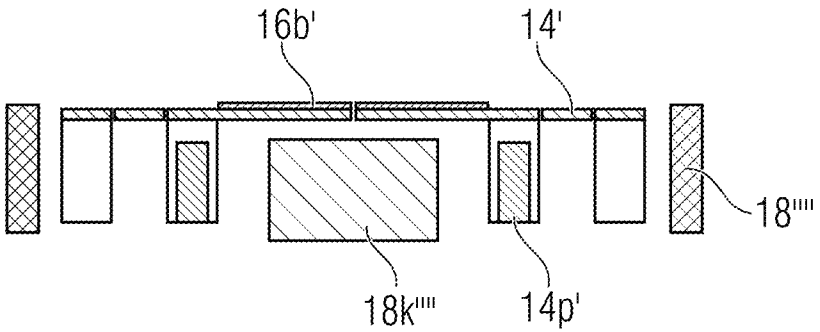
Figure 10I:
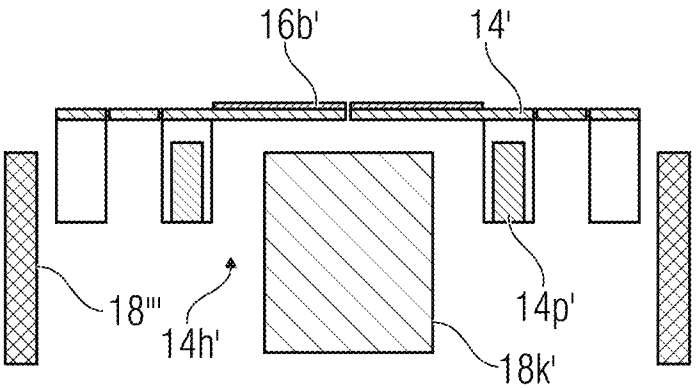

The embodiment of FIG. 10*i* corresponds to that of FIG. 10*f*, but the coil 18'" is provided in the region of the substrate rather than within the cavity 14*h*', as is the case in FIG. 10*f*. In all implementations of FIGS. 10*f* to 10*i*, the coil 18'/18" and the core 18*k*'/18*k*" are located within the substrate and/or below (i.e. within the lateral region) of the membrane plane. With regard to the permanent magnets, the coil 18'/18" and the core 18*k*'/18*k*" are therefore arranged in between or at least directly adjacently.

However, in the embodiment of FIG. 10*i*, the coil 18''' is arranged outside the cavity, i.e. within the substrate region. This is advantageous since in this manner, the coil may be formed directly within the substrate for reasons related to manufacturing. By using the central iron core 18*k*', good transfer of forces becomes possible despite the external arrangement of the coil 18'.

When comparing embodiments of FIGS. 10*f* and 10*i*, what is striking is that the size of the iron core may vary in relation to the diameter. Said variation essentially depends on the envisaged application. A further variation of the dimensions of the iron core 18*k*' and of the coil 18' will be explained below with reference to FIG. 10*j*.

The embodiment of FIG. 10*j* corresponds to that of FIG. 10*i*, but the core 18*k*'''' and the coil 18'''' are designed to be flatter: the coil 18'''' lines up with the substrate surface.

This flat design reduces the force that may be transferred to the membrane 14' but constitutes an optimization with regard to the structural dimensions.

Figure 10L:
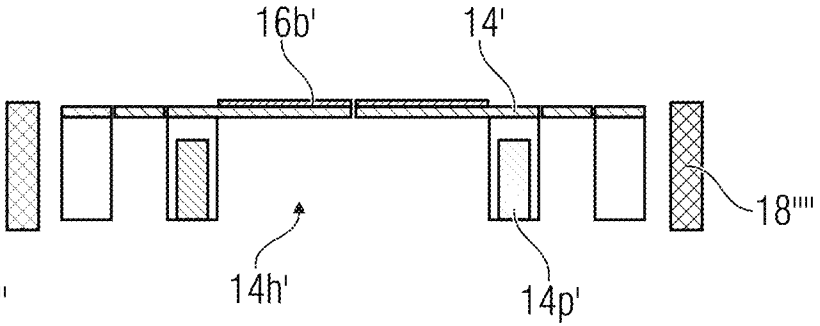
Figure 10K:
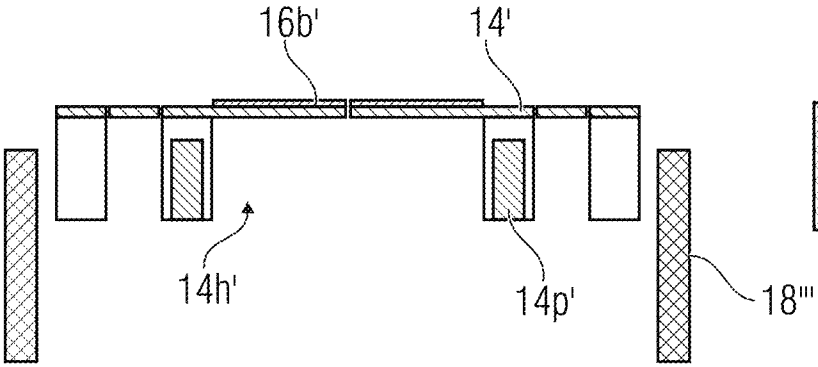

The embodiment of FIG. 10*k* corresponds to that of FIG. 10*i*, but no core is provided. The embodiment of FIG. 10*l* corresponds to that of FIG. 10*j*, but no core is provided.

With this embodiment of FIG. 10*k*, the overall dimensions, in particular within the region of the cavity 14*h*', may also be optimized. However, since the coil 18''' extends within the depth plane of the substrate, one achieves that high forces can be transferred.

The embodiment of FIG. 10*l* essentially corresponds to the embodiment of FIG. 10*k*; the coil 18'''' does not extend quite as far into the depth, but instead it extends (as it already does in FIG. 10*j*) precisely from the surface to the underside of the cavity 14*h*', and therefore, an optimized structural design is achieved. With this arrangement, e.g., the maximum force effect is achieved in the deflected state.

Figure 10M:
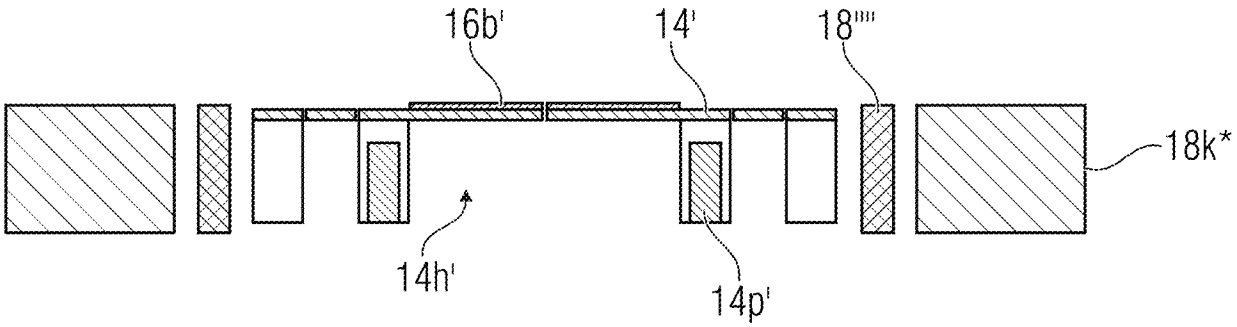

The embodiment of FIG. 10*m* corresponds to that of FIG. 10*l*, but the core 18*k is provided next to the coil 18''''**, i.e. lines up with the substrate surface.

The embodiment of FIG. 10*m* is a further development of the embodiment of FIG. 10*k*; here, the core 18*k (here a concentric core) is provided outside the cavity 14***h*', i.e. next to the coil 18''''. In summary, this means that the elements 18*k and 18'''' extend around the cavity 14***h*' as concentric elements, i.e. may thus be embedded within the substrate. On the one hand, this embodiment is advantageous as far as manufacturing is concerned, and enables a large force effect. For the sake of completeness it shall be noted that what is depicted here is a variant having a reduced height for optimizing the installation height, wherein the core 18*k and the coil 18'''' extend from the surface of the MEMS component as far as approximately the depth of the cavity 14***h*'. In accordance with further embodiments, the elements 18*k and 18''''** may vary with regard to their dimensions (in particular their heights, but also their diameters), so that due to an extension into greater depth, the transferrable force is increased further.

FIGS. 10*f* to 10*m* are sectional representations, so that the explanations described in one dimension may evidently also be transferred to a different dimension.

Now that optional embodiments of the MEMS device 10' were explained in accordance with the implementation details, manufacturing and further optional features will be addressed.

The permanent magnetic structures 14*p*' contained within the frame 14*r*' may be manufactured by using a novel technology which is based on agglomerating of loose powder by means of atomic layer deposition [22]. The latter enables integrating three-dimensional microstructures having edge lengths of between 50 μm and 2,000 μm on Si substrates in a manner that is reproducible and that is compatible with standard processes of semiconductor and MEMS production. Outstanding magnetic properties with high reproducibility have been identified for integrated micro magnets manufactured from NdFeB powder [23]. Long-term stability of NdFeB micro magnets is very high.

The proposed approach has numerous advantages over the current state of the art. Subdividing a sound transducer into a multi-way system is common use in conventional sound transducers. In this manner, the individual components may be tuned to the respective frequency range for sound generation. In this case, the combination of two different modes of driving, which becomes possible as a result, is particularly advantageous since said modes do not influence each other.

Figure 3B:
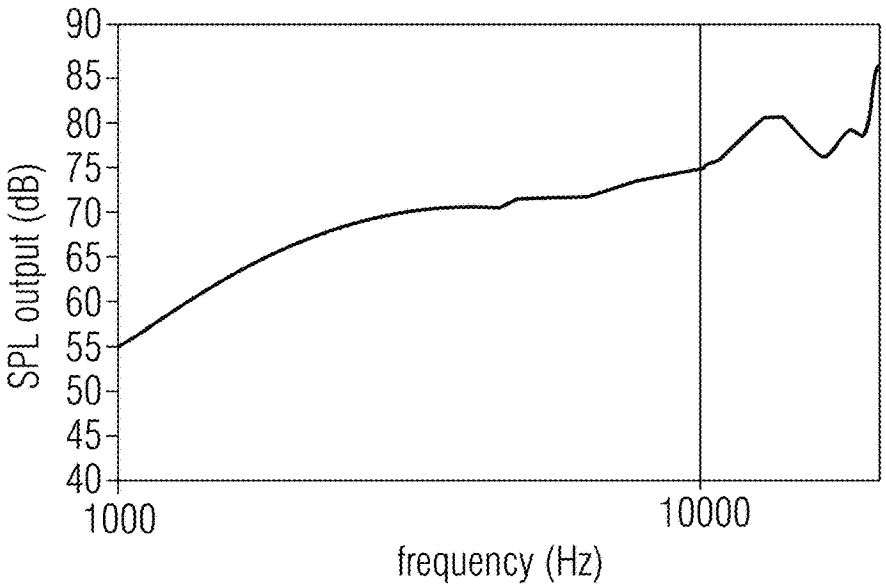
FIGS. 3*a*, 3*b* show a schematic representation of a design of a MEMS sound transducer on the basis of a piezoelectric bending actuator along with corresponding performance data.
Figure 3A:
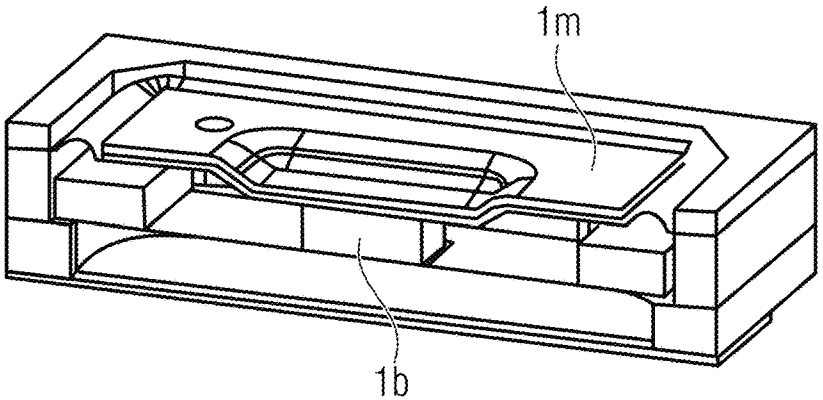
Figure 5B:
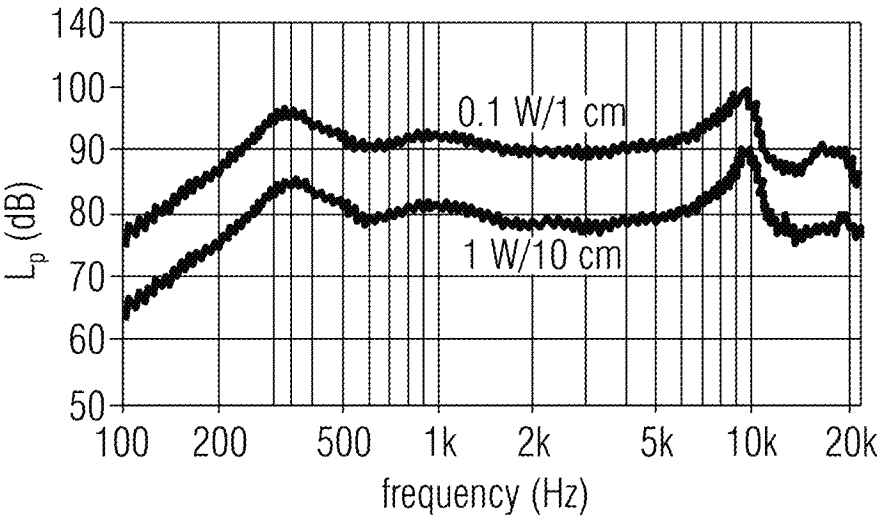
Figure 5A:
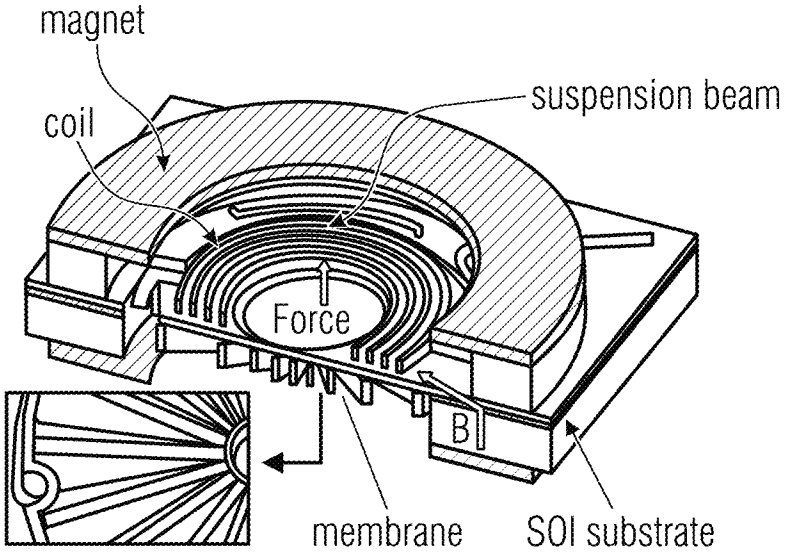
Figure 6B:
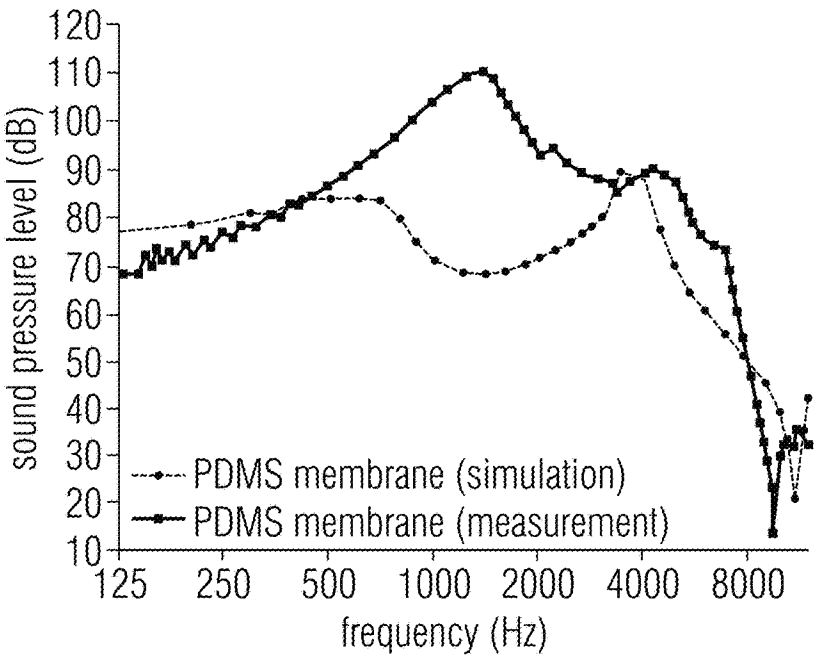
Figure 6A:
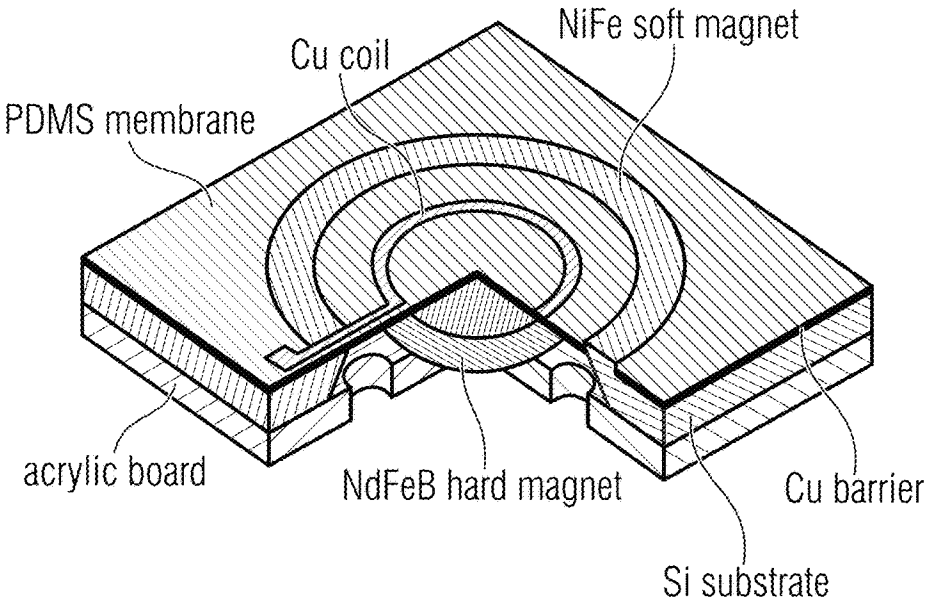

As was explained in the description of the problem, the sound pressure level that has been achieved in the free field fundamentally depends on the frequency (cf. equation 1). Apart from in-ear applications, this results in that the sound pressure level of micro loudspeakers will undergo a severe drop at low frequencies, as is the case in conventional technology and can be seen in FIGS. 1, 3, 5. The effect can only be compensated for by increasing the displaced volume. In the approach described, the volume displaced by the woofer is maximized on account of several aspects. The woofer uses the entire surface area of the component as an active surface, integrating the tweeter in the active surface of the woofer saves the additional surface area which would otherwise be used for a two-way system. Due to the implementation as piston-type resonators, the average deflection of the active surface equals the maximum deflection; with a flexural resonator, the average deflection would only be a fraction of the maximum deflection. Because of the electrodynamic drive, the effective power may be transferred over a larger distance, and therefore, higher maximum deflections may be achieved.

The separate tweeter enables exploiting a different drive concept at high frequencies. Here, piezoelectric drive concepts are particularly suitable since they have higher energy efficiency and lower distortions at high frequencies as compared to electrodynamic drives. Integration within the active surface of the woofer does not present a problem since due to being configured for higher frequencies, the sound transducer structures become smaller as a matter of principle. Due to the frequency dependence (see equation 1), a comparable sound pressure level may be implemented while using a smaller active surface and smaller average deflections.

While with a tweeter, one may fall back on existing technologies for micro sound transducers [4,7], the configuration of the electrodynamic drive for the woofer has a particular significance. The powder MEMS technology that has been developed enables integrating large-volume permanent magnets during manufacturing of a MEMS component. In particular, this is also compatible with piezo MEMS technology, so that integration into the frame of a piezoelectrically driven tweeter is possible. The magnetic force effect scales with the volume, so that the powder magnets to be integrated into the tweeter should be as large as possible. So as not to influence the functionality of the tweeter, one may suitably use a frame.

Figure 11A:
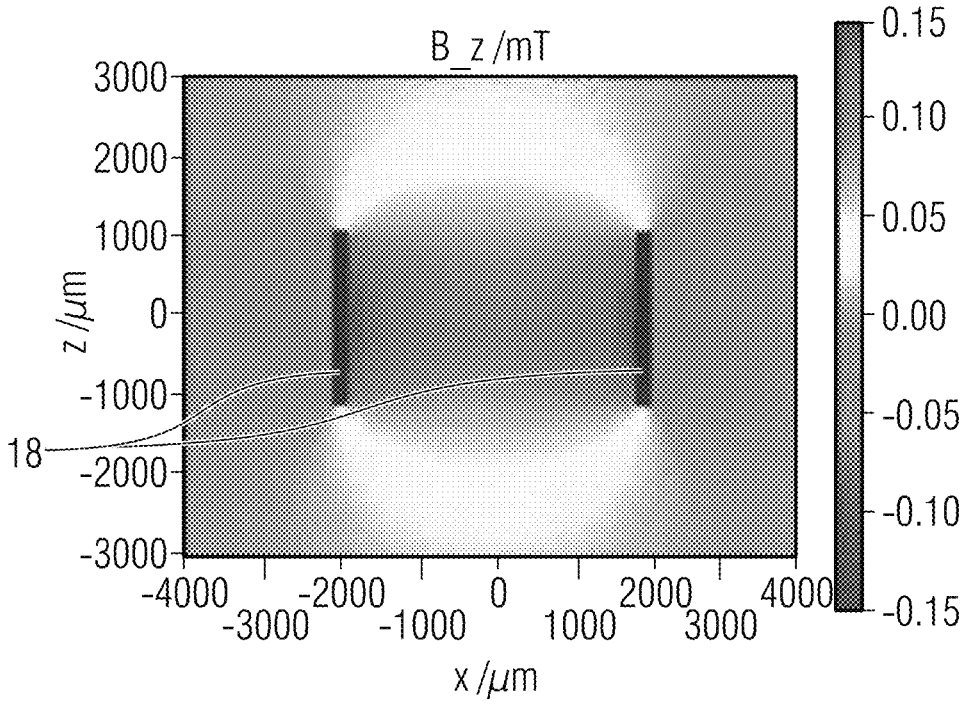
FIGS. 11*a*, 11*b* show a magnetic flux density in a z direction in the cross section of a coil (cf. a) and the resulting force effect in the z direction on a magnetic dipole (cf. b) in accordance with embodiments explained above.

Integrating the permanent magnets into the frame additionally serves to maximize the magnetic force effect. FIG. 11*a* shows the magnetic flux density $B_z$ in the z direction of a coil which is oriented along the z axis and consists of 25 turns with a diameter of 4 mm and a total length of the coil of 2 mm. The origin of the coordinate system that is used extends through the center of the coil; what is shown is the section in the xz plane, the demarcation of the coil is indicated by the black lines.

Figure 7B:
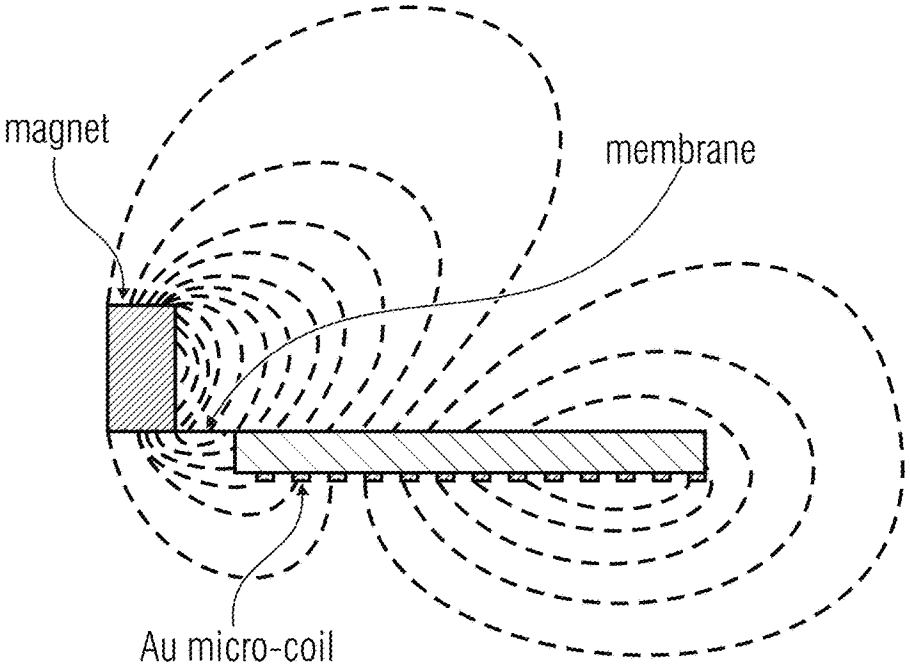
Figure 7A:
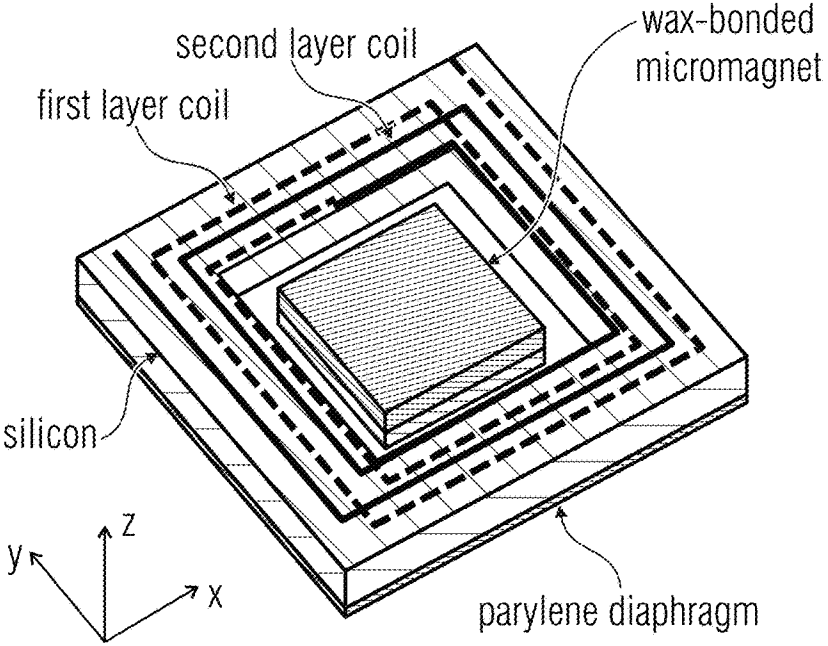
Figure 8B:
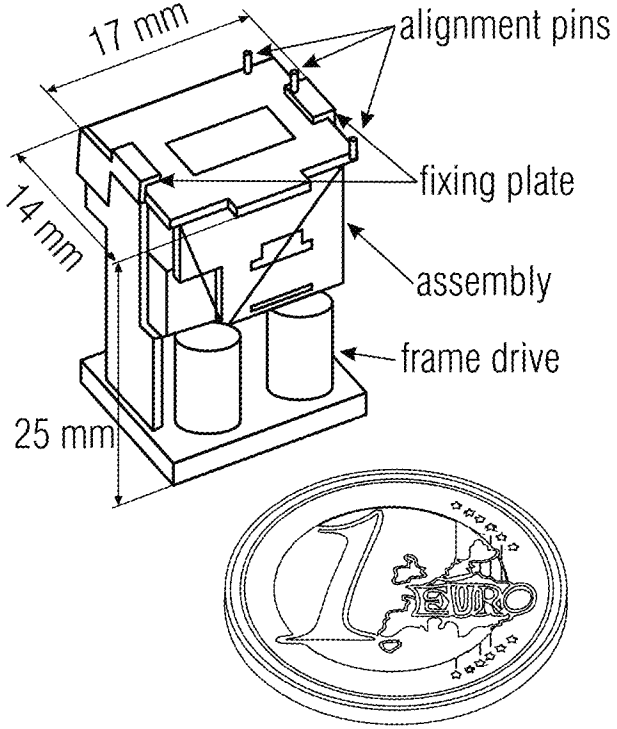
Figure 8A:
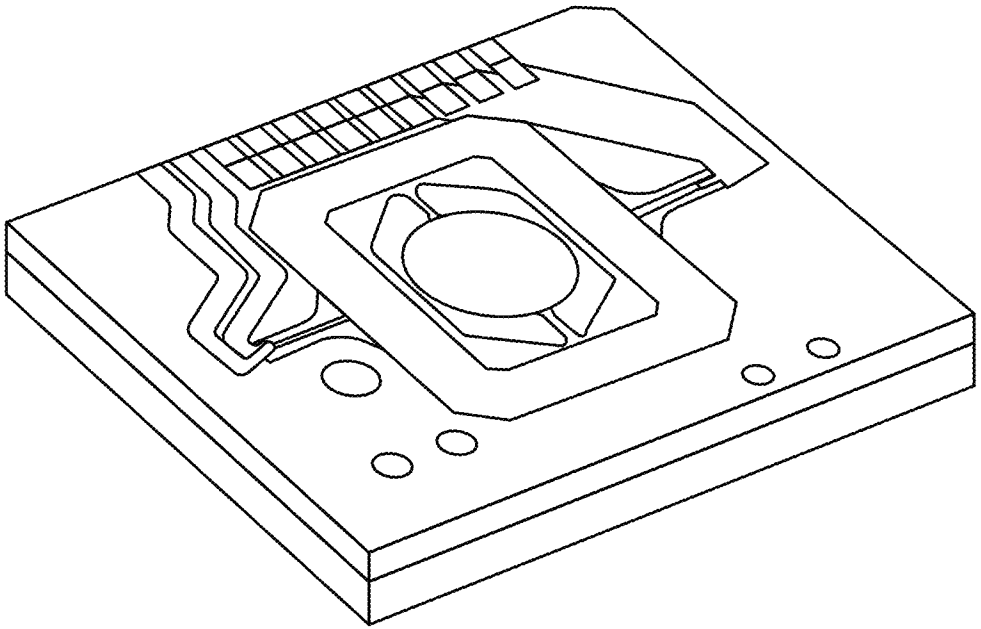
Figure 11B:
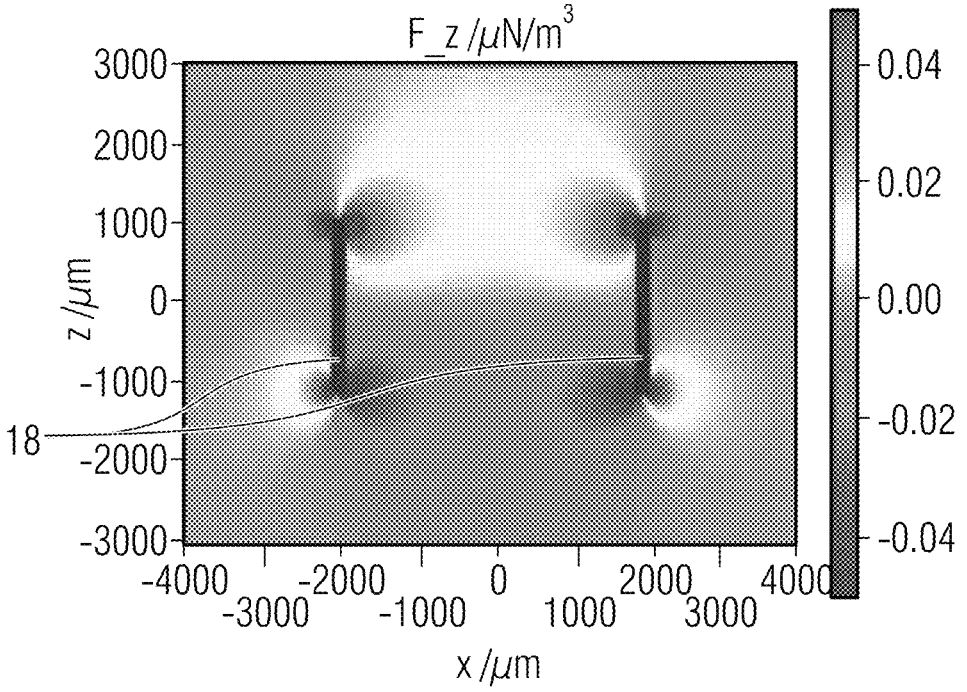

The magnetic flux density $B_z$ is relatively homogenous at the center of the coil, and heavily decreases outside the coil 18 (see non-hatched area). The magnetic force effect exerted on a magnetic dipole moment (e.g. of a permanent magnet) is proportional to the gradient of the scalar product of the flux density and the dipole moment. For a permanent magnet that is magnetized along the z direction, the force effect in the z direction is directly proportional to the gradient of the flux density $B_z$ shown in FIG. 11*a*. FIG. 11*b* shows the force effect in the z direction per volume of a permanent magnet that is magnetized with 500 mT in the z direction. As also can be seen in FIG. 11*a*, the maximum force effect does not occur at the maximum flux density, but at the heaviest drop. Instead of a centered position of the permanent magnet along the coil axis, as is shown in FIG. 7, for example, a position that is as close to the coil winding as possible is advantageous in terms of achieving the maximum force effect. Any additional volume of the permanent magnet at the center of the coil contributes only little to the force effect and has been omitted in the approach presented for geometrical reasons concerning integration of the tweeter functionality and the reduction of the weight of the tweeter platform.

Figure 11C:
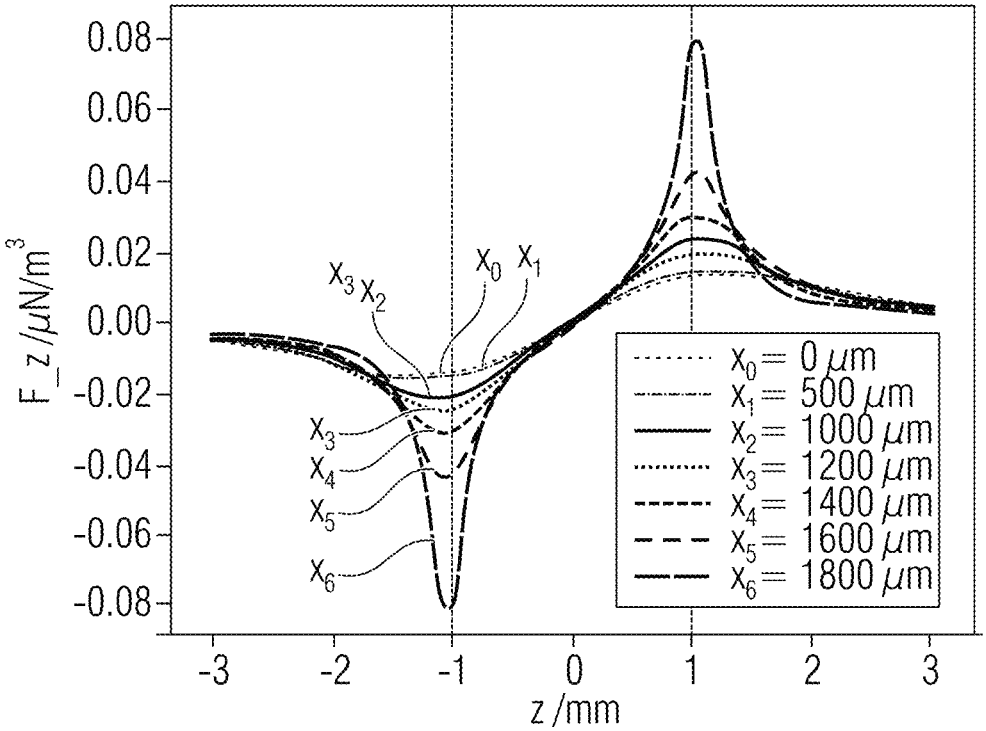
FIGS. 11*c*-11*e* show schematic diagrams for illustrating a force effect on an individual cuboid magnet within the magnetic field of a coil.
Figure 11D:
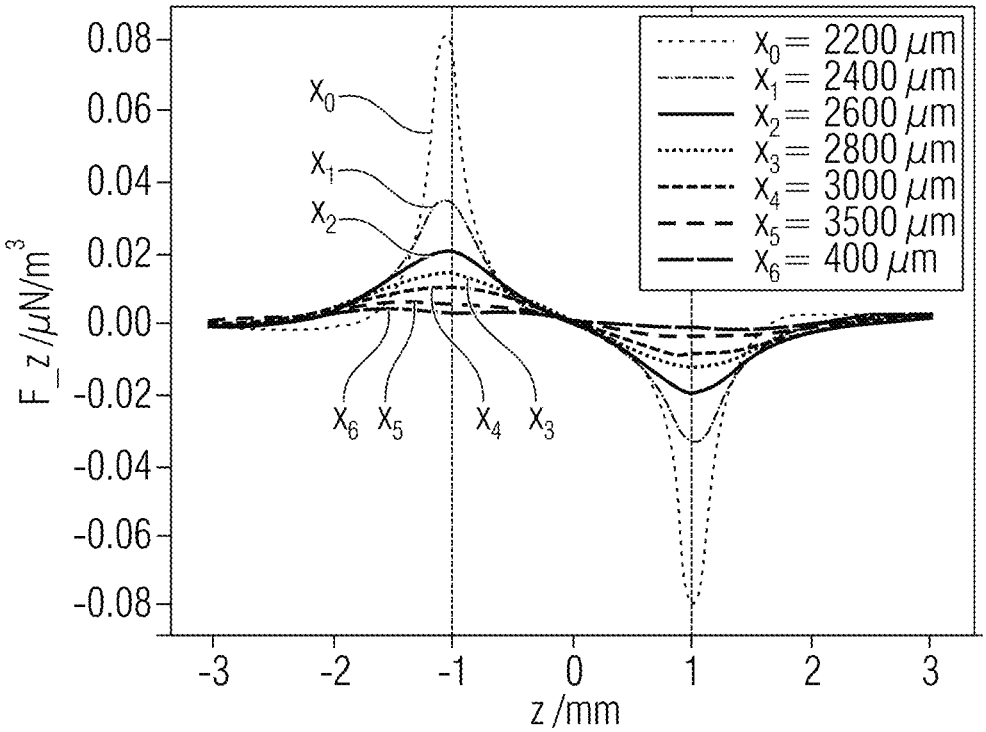

FIGS. 11*c* and 11*d* exemplify this connection. What is plotted is the curve of the force effect in the z direction per volume (x0-x6≙0-1,800 μm and/or 2,200-4,000 μm) along the z axis for various x positions (vertical sections through FIG. 11*b*). The achievable force effect clearly increases as the position approaches the coil windings more and more closely. This connection is not limited to the interior of the coil. As can be seen in FIGS. 11*a* and 11*b*, a similar progression occurs outside the coils, with reversed signs. For this case, too, the curves of the force effect per volume are shown in FIG. 11*d* by way of an example.

In addition to lateral relative positioning of the permanent magnets and the coil, conclusions may be drawn in terms of optimum vertical relative positioning. As can be seen in FIGS. 11*c* and 11*d*, the maximum force effect occurs at the vertical ends of the coil. Thus, this position should occur at the point of full deflection of the woofer so as to achieve maximum deflection in relation to spring-mounting of the woofer. However, vertical centering of the permanent magnets and of the coil may also be advantageous. In this case, even though a lower force effect is available, said force effect will extend in a manner that is linear to the vertical displacement, in this case to the deflection of the woofer. A linear force progression is advantageous for minimizing the distortions.

Thus, for positioning the permanent magnets within the frame of the tweeter and the coil, which possibly comprises core material, the possibilities shown in FIGS. 10*f* to 10*m* therefore result, among others, in order to exploit the above-described increased force effect in the vicinity of the coil windings. Additional variations are effected by the shapes and positioning of the permanent magnets within the frame of the tweeter. The coil may be implemented in different ways. What is feasible are, among others, coils based on MEMS technology, conventionally wound coils, coils consisting of multi-layered circuit boards, and coils based on ceramic material. The core material may be a body or may advantageously be composed of several bodies having high aspect ratios.

Figure 11E:
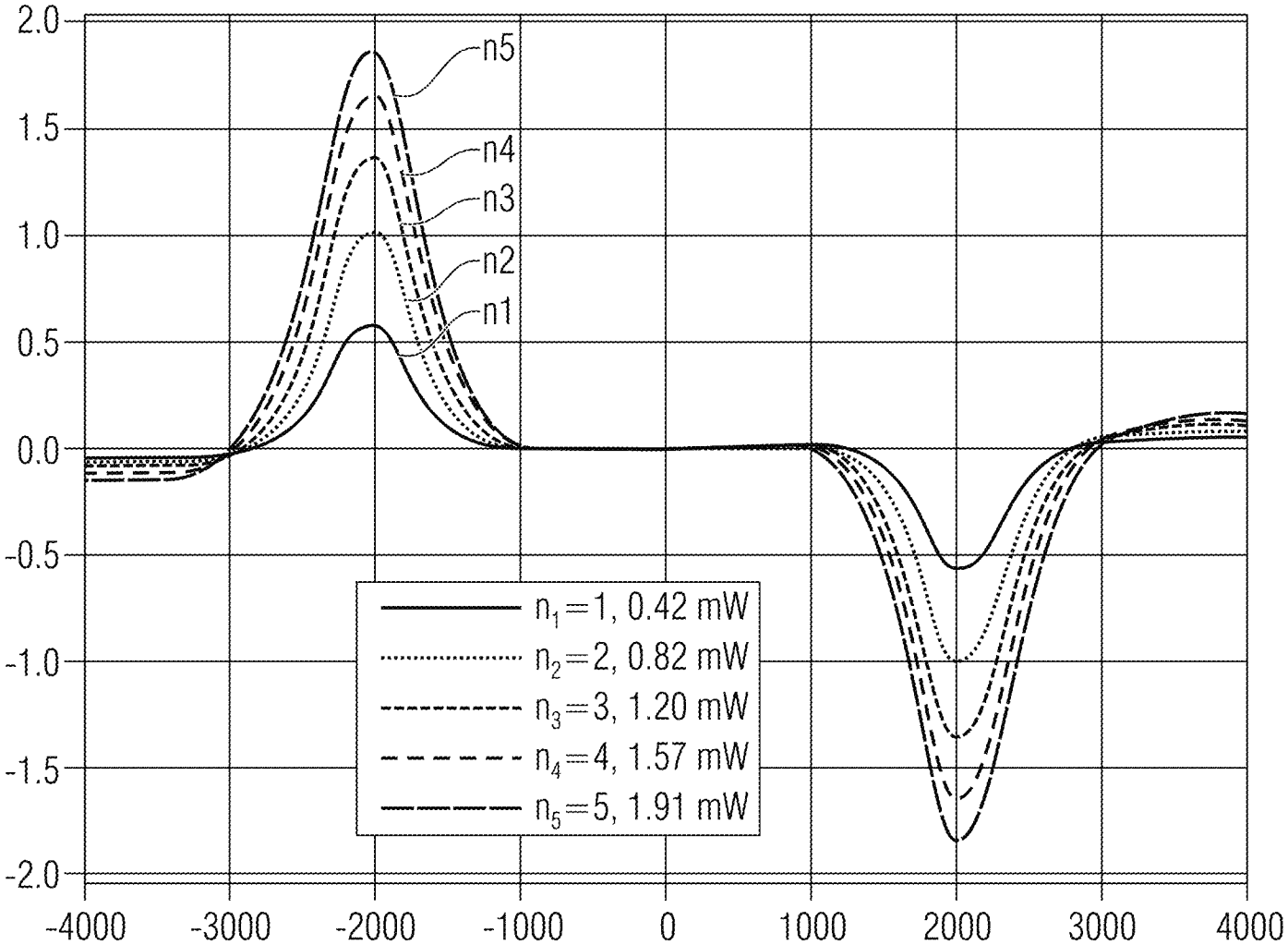

For the advantageous embodiment shown in FIG. 10*a*, the achievable forces for driving the woofer were estimated by numerical simulation. What was calculated was the force effect on a single cuboid magnet exhibiting dimensions of 200 μm×200 μm×500 μm and a magnetization of 500 mT. At least 50 such magnets may be accommodated within the frame of a tweeter having an active surface of 4 mm in terms of diameter. In the calculated example, said magnets are located on a circle having a radius of 2.2 mm. The coil has a maximum outer diameter of 3.9 mm and a length of 4 mm. It is made of 50 windings per layer made of AWG 40 wire. The force which acts upon the individual magnets at a current of 14 mA through the coil as a function of the number of layers n (n1-n5) is shown in FIG. 11*e*. The force is plotted over the relative distance between the center of the magnet and the center of the coil, along the z axis. In addition, the key indicates the power loss which in the stationary case occurs due to the resistance of the coil wire.

As can be seen in FIG. 11*e* by way of example, a force of approx. 2 μN per magnet can be achieved with 5 winding layers of the coil. When multiplied by the number of magnets, a force of 100 μN results which is exerted on the frame of the tweeter.

Figure 11F:
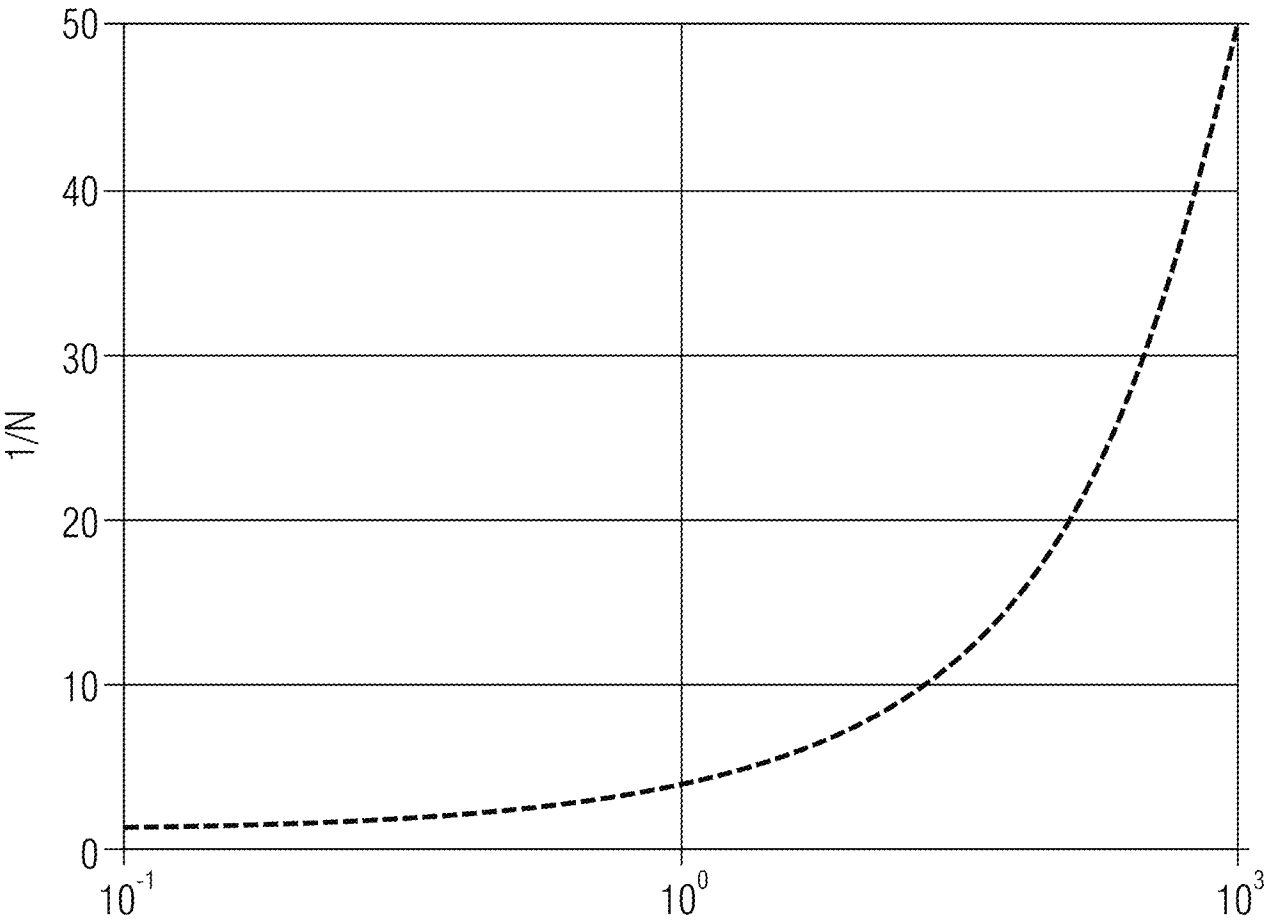
FIG. 11*f* shows a schematic diagram for illustrating an amplification factor 1/N of a cylindrical core with an aspect ratio L/D.

The force effect may be further augmented by using a suitable core material. It is to be noted here that the demagnetization field of the core material conflicts with magnetization by the coil. As a function of the aspect ratio of length/diameter L/D of the core, the amplification factor 1/N results for a cylindrical core of an ideal soft-magnetic material as shown in FIG. 11*f*. With an aspect ratio of 1:1, an amplification factor of approx. 3 is to be expected, and with an aspect ratio of 3:1, an amplification factor of approx. 10 is to be expected. So as to nevertheless implement a high aspect ratio of the core even with a limited installation height, it is desirable to subdivide the core into several individual parts having high aspect ratios. Therefore, in the calculation example, the forces which may be used for a micro sound transducer may be achieved within the mN range.

Combining the two sound transducers within one component places requirements on mechanical implementation. The actuators of the tweeter are to be produced with sufficient stiffness so as to prevent movement upon actuation of the woofer. This can be put into practice by configuring the tweeter for a frequency range higher than that of the woofer. Controlling the two ways is to be implemented by means of suitable electronics having an active or passive frequency-dividing network.

Figure 4B:
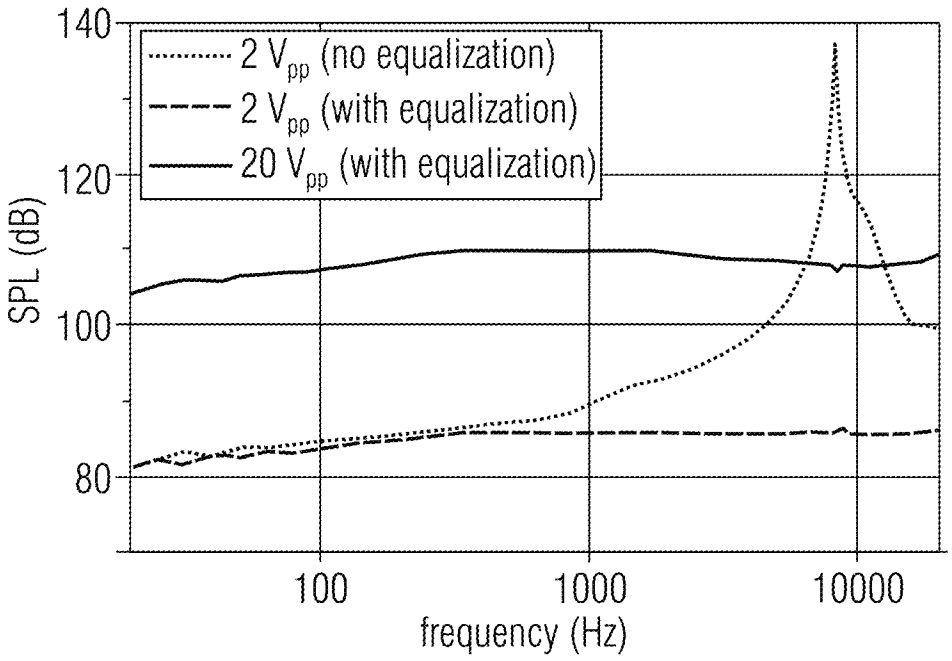
FIGS. 4*a*, 4*b* show a schematic design of a piezoelectric MEMS sound transducer comprising an additional membrane, along with corresponding performance data.
Figure 4A:
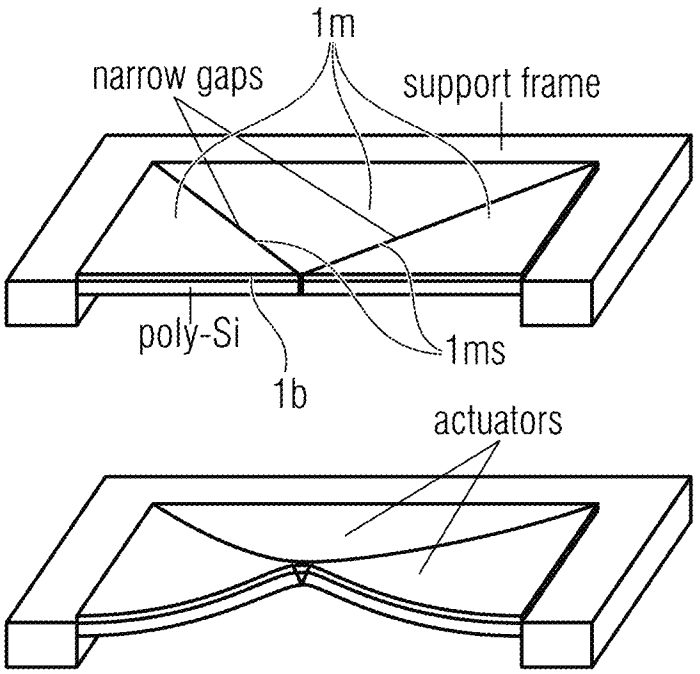

The embodiments show the advantageous implementation of the tweeter in the technology shown in FIG. 4 [7]. The approach described may also be implemented by using other technologies for tweeters, however. These include, for example, the technology shown in FIG. 3 [4], where the piezo actuators deflect an additional membrane mounted in a hybrid manner. In accordance with said two technologies, two possibilities result also for sealing the sprung suspension of the active surface of the woofer. The springs may be sufficiently sealed off by means of slits selected to be narrow and by baffle structures; alternatively, an additional membrane, which advantageously consists of a soft material, may be used for separating front and rear volumes.

It shall be noted at this point that the technology explained above may be employed, in particular, within the field of micro sound transducers. The latter are used in consumer electronics, telecommunication technology, and medical engineering. Possible applications include headphones (in-ear headphones or over-ear headphones), portable devices (smartphones, tablets, hearables) and hearing aids.

Further embodiments will be explained below: an embodiment in accordance with one aspect provides a two-way micro sound transducer system in MEMS technology which includes a woofer and a tweeter. In corresponding embodiments, the woofer is driven electrodynamically. In accordance with further embodiments, the woofer is driven electrodynamically, and the tweeter is driven piezoelectrically.

In accordance with embodiments, the tweeter forms part of the active surface of the woofer.

In accordance with embodiments, the micro sound transducer has dimensions of approx. 50 mm×50 mm×10 mm, or a maximum dimension of 50 mm×50 mm×10 mm. In accordance with advantageous embodiments, the dimensions will not exceed 10 mm×10 mm×5 mm. Consequently, the micro sound transducer will be smaller than 10 mm×10 mm×5 mm.

In accordance with an embodiment, the electrodynamic drive of the woofer includes at least one, advantageously several, permanent magnets which are implemented within the frame of the tweeter.

In accordance with embodiments, the higher force effect which exists in the vicinity of the coil winding is exploited here.

In accordance with further embodiments, the permanent magnet which is integrated within the frame of the tweeter and is located within the plane is equipped with an edge length, or a diameter, of between 20 μm and 2,000 μm, advantageously between 50 μm and 1,000 μm, and particularly advantageously between 50 μm and 500 μm.

In accordance with embodiments, the active surface of the woofer is spring-suspended, e.g. by means of slots selected to be narrow, of a baffle structure, or of an additional sealing membrane.

It shall be noted with regard to the substrate that in accordance with embodiments, said substrate may be made of silicon or a different material.

As was already explained above, one embodiment relates to a manufacturing method. It shall be noted here that said manufacturing method may comprise, in particular, agglomerating loose powder by means of atomic layer deposition so as to produce the permanent magnetic structures. The further manufacturing steps are such steps which use conventional MEMS manufacturing technologies. It shall be noted at this point that in connection with the above-explained devices, explanations also present explanations of the corresponding manufacturing step, so that no additional indications will be given here.

Even though in above embodiments, the (MEMS) sound transducer was explained as a (MEMS) loudspeaker, it shall be noted that same may also be implemented as a passive sound transducer, i.e. as a sensor for sound recording (e.g. microphones). In accordance with embodiments, the sound transducer is to be understood to be an air sound transducer. In addition, it shall be noted that an air sound transducer is to be understood to be a sound transducer which may record and output air-borne acoustic sound or even ultrasound (exemplary frequency range 1 Hz-400 kHz).

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

BIBLIOGRAPHY

[1] "Product Data Sheet 2403 260 00132", Knowles Electronics LLC, 2013

[2] "What is Balanced Armature Receiver Technology", Sonion, 2016

[3] "Data Sheet Receiver 2323", Sonion, 2015

[4] Patent Application DE 10 2014 217 798, "Mikromechanische piezoelektrische Aktuatoren zur Realisierung hoher Kräfte and Auslenkungen"

[5] "Data Sheet Achelous, MEMS-based microspeaker for headphones, wearables and array applications", USound GmbH, 2018

[6] F. Bottoni, "Challenging the audio Market with MEMS Micro Speaker Technology", presented at COMS2018, 2018

[7] F. Stoppel, A. Männchen, F. Niekiel, D. Beer, T. Giese, B. Wagner, "New integrated full-range MEMS speaker for in-ear applications", IEEE Micro Electro Mechanical Systems (MEMS), 2018 as well as DE 10 2017 208 911 A1

[8] Patent Document U.S. Pat. No. 9,237,961 B2

[9] I. Shahosseini, E. Lefeuvre, J. Moulin, E. Martincic, M. Woytasik, G. Lemarquand, IEEE Sens. J. 13 (2013), pp. 273-284

[10] E. Sturtzer, I. Shahosseini, G. Pillonnet, E. Lefeuvre, G. Lemarquand, "High fidelity microelectromechanical system electrodynamic micro-speaker characterization", J. Appl. Phys. 113 (2013), 214905

[11] F. L. Ayatollahi, B. Y. Majlis, "Materials Design and Analysis of Low-Power MEMS Microspeaker Using Magnetic Actuation Technology", Adv. Mater. Res. 74 (2009), pp. 243-246

[12] Y. C. Chen, Y. T. Cheng, "A low-power milliwatt electromagnetic microspeaker using a PDMS membrane for hearing aids application", IEEE Int. Conf. Micro Electro Mech. Syst., 24$^{th}$ (2011), pp. 1213-1216

[13] M.-C. Cheng, W.-S. Huang, S. R.-S. Huang, "A silicon microspeaker for hearing instruments", J. Micromech. Microeng. 14 (2004), pp. 859-866

[14] S.-S. Je, F. Rivas, R. E. Diaz, J. Kwon, J. Kim, B. Bakkaloglu, S. Kiaei, J. Chae, "A Compact and Low-Cost MEMS Loudspeaker for Digital Hearing Aids", IEEE Trans. Biomed. Circ. Sys. 3 (2009), pp. 348-358

[15] B. Y. Majlis, G. Sugandi, M. M. Noor, "Compact electrodynamics MEMS-speaker", China Semiconductor Technology International Conference (CSTIC), 2017

[16] P. R. Jadhav, Y. T. Cheng, S. K. Fan, C. Y. Liang, "A sub-mW Electromagnetic Microspeaker with Bass Enhancement using Parylene/Graphene/Parylene Composite Membrane", IEEE Micro Electro Mechanical Systems (MEMS), 2018

[17] C. Shearwood, M. A. Harradine, T. S. Birch, J. C. Stevens, "Applications of Polyimide Membranes to MEMS Technology", Microelectron. Eng. 30 (1996), pp. 547-550

[18] Q. Zhang, E. S. Kim, "Fully-microfabricated electromagnetically-actuated membrane for microspeaker", Transducers '15, Int. Conf. Solid. State Sens., Actuators Microsyst., 2015, pp. 2125-2128

[19] C. L. Arrasmith, D. L. Dickensheets, A. Mahadevan-Jansen, "MEMS-based handheld confocal microscope for in-vivo skin imaging", Opt. Express 18 (2010), pp. 3805-3819

[20] D. James, "STMicroelectronics Micromirrors, Microvision and Sony Bring Pico-Projection to the Pocket", online: http://www.chipworks.com/about-chipworks/overview/blog/stmicroelectronics-micromirrors-microvision-and-sony-bring-pico

[21] I. Aoyagi, K. Hamaguchi, Y. Nonomura, T. Akashi, "A raster-output 2D MEMS scanner with an 8×4 mm mirror for an automotive time-of-flight image sensor", $17^{th}$ International Conference on Solid-state Sensors, Actuators and Microsystems, 2013

[22] Patent Document EP 2 670 880 B1, "Verfahren zum Erzeugen einer dreidimensionalen Struktur sowie dreidimensionale Struktur"

[23] T. Reimer, F. Lofink, T. Lisec, C. Thede, S. Chemnitz, B. Wagner, "Temperature-stable NdFeB micromagnets with high-energy density compatible with CMOS back end of line technology", MRS Advances 1, (2016), pp. 209-213

The invention claimed is:

1. Sound transducer comprising:

a substrate;

a membrane which is formed within the substrate, is connected to at least one integrated permanent magnet and is electrodynamically controllable; and a bending actuator which is applied onto the membrane and is piezoelectrically controlled separately from the membrane;

wherein the bending actuator is configured to emit a sound;

wherein the membrane is connected to a frame that is electrodynamically controlled along with the membrane; and wherein the membrane is connected to the frame which has the at least one permanent magnet integrated therein, the frame being electrodynamically controlled along with the membrane.

2. Sound transducer as claimed in claim 1, wherein the bending actuator comprises a membrane divided by a gap.

3. Sound transducer as claimed in claim 2, wherein the membrane divided by the gap comprises two halves; or wherein the membrane divided by the gap comprises four quadrants or a multitude of elements.

4. Sound transducer as claimed in claim 2, wherein the gap is smaller than 5 μm, smaller than 25 μm, smaller than 50 μm, or smaller than 100 μm in a non-deflected state of the bending actuator.

5. Sound transducer as claimed in claim 1, wherein the bending actuator comprises an additional membrane driven by the bending actuator; or wherein the bending actuator comprises an additional membrane driven by the bending actuator and connected to the substrate via a flexible region of the additional membrane.

6. Sound transducer as claimed in claim 1, wherein the membrane or a frame of the membrane is spring-mounted in relation to the substrate.

7. Sound transducer as claimed in claim 6, wherein the spring mounting is implemented by a decoupling slot, a baffle structure or an elastic connection; and/or wherein the spring mounting is implemented by a baffle structure, said baffle structure projecting out of the substrate plane, and/or the baffle structure exhibiting a height of at least 0.5 or 0.75 or 1.0 of the maximum deflection of the electrodynamically driven membrane.

8. Sound transducer as claimed in claim 1, wherein the membrane acts as a piston-type transducer.

9. Sound transducer as claimed in claim 1, wherein the sound transducer comprises a coil which interacts with the at least one integrated permanent magnet so as to electrodynamically drive the membrane.

10. Sound transducer as claimed in claim 9, wherein the coil is arranged centrally below the membrane or along the outer contour of the membrane or concentrically around the membrane.

11. Sound transducer as claimed in claim 9, wherein the coil is coupled to a core which is arranged centrally below the membrane, around the edge region of the membrane or concentrically around the membrane.

12. Sound transducer as claimed in claim 1, wherein the membrane is a silicon membrane and/or a semiconductor membrane.

13. Sound transducer as claimed in claim 1, wherein the sound transducer is configured to map a first frequency range by means of the electrodynamically drivable membrane and to map a second frequency range by means of the bending actuator, the second frequency exhibiting a center frequency higher than that of the first frequency range, or the second frequency range comprising frequencies higher than those of the first frequency range.

14. Sound transducer as claimed in claim 1, which additionally comprises signal processing configured to split a frequency range that is to be transmitted into first and second frequency ranges, wherein signals belonging to the first frequency range are electrodynamically reproduced by means of the sound transducer, and signals belonging to the second frequency range are reproduced by means of the bending actuator, the second frequency exhibiting a center frequency higher than that of the first frequency range, or the second frequency range comprising frequencies higher than those of the first frequency range.

15. Sound transducer as claimed in claim 1, wherein two different transducer drive technologies are used; and/or wherein a transducer drive technology for driving the membrane differs from a transducer drive technology for driving the bending actuator.

16. Micro loudspeaker, headphone or in-ear headphone comprising at least one Micro-Electro-Mechanical System (MEMS) sound transducer comprising:

a substrate;

a membrane which is formed within the substrate, is connected to at least one integrated permanent magnet and is electrodynamically controllable; and a bending actuator which is applied onto the membrane and can be piezoelectrically controlled separately from the membrane;

wherein the membrane is connected to a frame that is electrodynamically controlled along with the membrane; and wherein the membrane is connected to the frame which has the at least one permanent magnet integrated therein, the frame being electrodynamically controlled along with the membrane.

17. Method of producing a sound transducer comprising:

a substrate;

a membrane which is formed within the substrate, is connected to at least one integrated permanent magnet and is electrodynamically controllable; and a bending actuator which is applied onto the membrane and can be piezoelectrically controlled separately from the membrane;

said method comprising agglomerating powder to produce at least one permanent magnet or to produce at least one permanent magnet on the membrane;

wherein the membrane is connected to a frame that is electrodynamically controlled along with the membrane; and wherein the membrane is connected to the frame which has the at least one permanent magnet integrated therein, the frame being electrodynamically controlled along with the membrane.

* * * * *